US005582061A

United States Patent [19]

Harsch et al.

[11] Patent Number: 5,582,061

[45] Date of Patent: Dec. 10, 1996

[54] TRANSPORT DEVICE FOR WORKPIECES IN A PRESS

[75] Inventors: Erich Harsch, Weingarten; Rainer Reichenbach, Schlier, both of Germany

[73] Assignee: Mueller-Weingarten AG, Weingarten, Germany

[21] Appl. No.: 397,640

[22] Filed: Mar. 2, 1995

[30] Foreign Application Priority Data

Mar. 12, 1994 [DE] Germany ..... 44 08 450.1

[51] Int. Cl.[6] ..... B21D 43/05

[52] U.S. Cl. ..... 72/405.1; 72/405.16

[58] Field of Search ..... 72/405.16, 405.1, 72/405.11, 405.12, 405.13, 405.01, 405.02

[56] References Cited

U.S. PATENT DOCUMENTS

| | | | |
|---|---|---|---|
| 5,105,647 | 4/1992 | Maher | 72/405.10 |
| 5,140,839 | 8/1992 | Bruns | 72/405.10 |
| 5,337,594 | 8/1994 | Pettersson | 72/405.10 |

FOREIGN PATENT DOCUMENTS

| | | |
|---|---|---|
| 0210745 | 2/1987 | European Pat. Off. . |
| 0384188 | 8/1990 | European Pat. Off. . |
| 3233428 | 6/1983 | Germany . |
| 3329900 | 2/1984 | Germany . |
| 3320830 | 12/1984 | Germany . |
| 3842182 | 9/1989 | Germany . |
| 3824058 | 11/1989 | Germany . |
| 3843975 | 6/1990 | Germany . |
| 63-281719 | 11/1988 | Japan . |
| 2199781 | 7/1988 | United Kingdom . |
| 2243134 | 10/1991 | United Kingdom . |

*Primary Examiner*—Daniel C. Crane
*Attorney, Agent, or Firm*—Spencer & Frank

[57] ABSTRACT

A transport device for transporting workpieces through machining stations, especially of a multiple-die press, is proposed, in which the supporting or gripper rails can perform a 2-axial and/or 3-axial motion in the longitudinal direction of the press, in the vertical direction and in the transverse direction relative to the longitudinal direction of the press. For the performance of the lifting motion and of the transversely directed closing/opening motion of the supporting or gripper rails, a separate transport unit is provided, which supports the supporting or gripper rails using a transversely displaceable lifting column.

23 Claims, 26 Drawing Sheets

Fig.13a
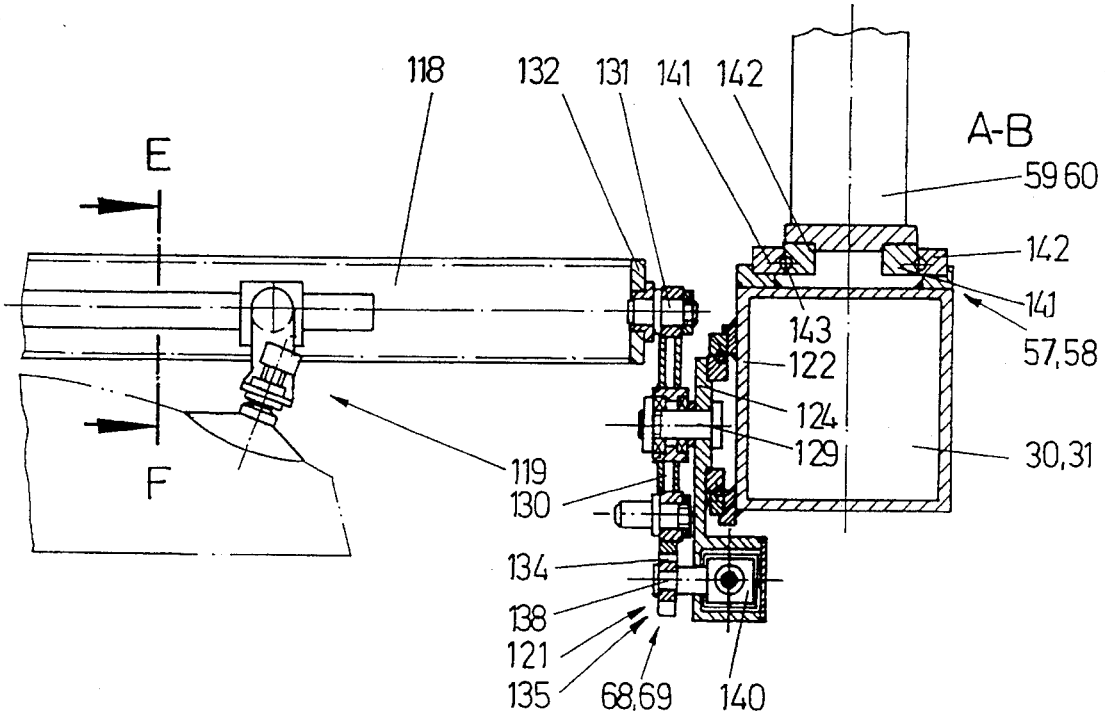
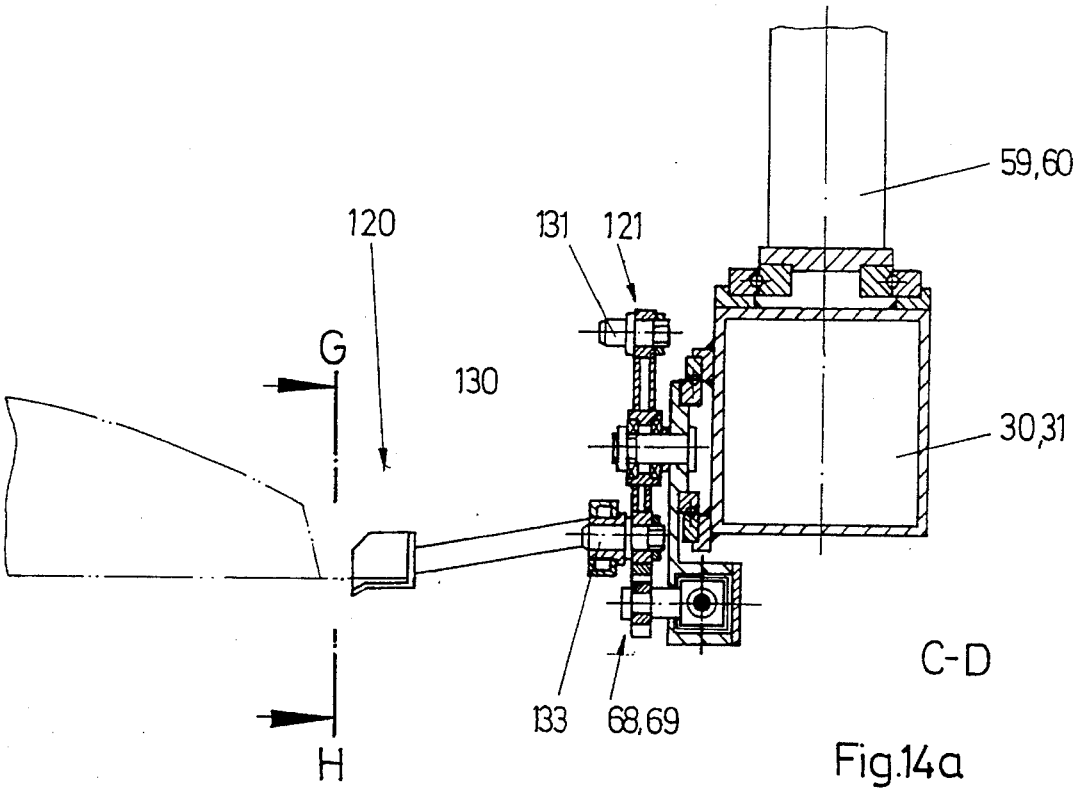
Fig.14a

E-F

G-H

TRANSPORT DEVICE FOR WORKPIECES IN A PRESS

BACKGROUND OF THE INVENTION

The invention relates to a transport device for transporting workpieces through machining stations, especially of a press. The transport device includes two parallel rails for receiving and transporting the workpieces through the machining stations. Advancement means are operatively connected to the rails for moving the rails in a horizontal, longitudinal direction of the press. Lifting means are operatively connected to the rails for moving the rails in an aligned, vertical direction. Closing/opening means are operatively connected to the rails for moving the rails in a direction transverse to the longitudinal direction of the press.

PRIOR ART

In transport devices for transporting workpieces through the machining station, especially of a transfer press, a distinction is drawn between a two-axis transfer and a 3-axis transfer, whereby the motion of the supporting or gripper fails is characterized. From DE 38 43 975 C1, a transport device having a 2-axis transfer has become known, for example, in which the supporting rails running through the press have cross-ties which perform a two-dimensional motion. In this case, the supporting rails jutting through the whole of the press chamber or slides for the cross-ties, which slides are guided on the supporting rails, execute a horizontal stroke in and counter to the transport direction of the workpiece, and a vertical stroke, the workpieces being fastened to cross-ties between the supporting rails, which cross-ties are fitted with suction devices or the like. Accordingly, a transverse motion of the supporting rails in order to grip the workpieces is not necessary. The cross-ties must however be positioned, during the machining cycle, in an intermediate setting outside the die chamber, so as not to disturb the machining cycle (see DE 38 24 058 C1).

In the case of a 3-axis transfer, the supporting or gripper rails, besides the longitudinal and lifting motion, also perform an additional transverse motion and, by means of gripper elements, grip the workpiece so as to transport it from one machining stage to the next. A basic representation of a three-dimensional drive of this kind is depicted in EP 0 210 745 A2, in particular in FIG. 4. If one of the motions, e.g. the lifting motion, were to be omitted, then this would once again become a 2-axis transfer.

From DE 38 42 182 C2, a gripper rail drive for a multiple-die press has become known, in which the gripper rails likewise execute a three-dimensional travel motion. In this instance, besides the customary longitudinal motion and lifting motion of the two parallel-running gripper rails, the additional transverse motion of the gripper rail is provided as a so-called "clamping motion" or "closing/opening motion" for gripping or clamping the workpieces. For this purpose, each gripper rail is mounted by means of a push rod in an articulated manner on a transversely displaceable slide, the slide for its part, in order to adapt to the respective workpiece size, being transversely displaceable relative to the longitudinal axis of the press into a fixed starting position. This transverse displacement accordingly serves as a set-up axis for the adjustment of the workpiece size. The respective closing/opening motion of the gripper rail is effected then as a lateral swivel motion or transverse motion, on a slide which is fixed in the transverse direction, by means of corresponding ball joints. The transversely displaceable slides themselves are fastened to a cross-tie, which is connected by customary driving levers to the gearbox casing of a central drive of the press. This gearbox casing is placed stationary in the front region or entry region of the multiple-die press and contains the customary cam disks down which rollers travel, for performing the forward-travel, clamping and lifting motions of the gripper rails. The driving of the gearing can be effected from the press head itself or by separate drives. The transverse motion of the gripper rail itself as a production axis is effected in this known system, in conventional fashion, by a closing box disposed beneath the gripper rails, which closing box is likewise driven by the central drive.

In practice, the gripper transfer is preferably used to transport flexurally rigid sheet-metal parts which are grippable from without, while a transfer with suction beams is suitable, in particular, for transporting large-area, unstable sheet-metal parts. The gripper transfer, in relation to the suction beam transfer, herein offers better freedom of passage for the die and is able, under equal accelerations, to execute a greater number of strokes. For this reason, it is uneconomical per se to use a transfer with suction beams to transport sheet-metal parts which can be transported using a gripper transfer. Depending upon the range of tasks, multiple-die presses have therefore hitherto been produced either as gripper transfer presses or suction beam transfer presses, there being no provision, because of the totally different sequences of motions, for converting from one system to the other.

Attempts have been made to perform a three-dimensional motion of the gripper rails using drives which are respectively separated from each other (DE 33 29 900 C2). The adjustment motion in the 3 axes is herein effected essentially by means of rack-and-pinion gears with individual motors. This gives rise to a high level of technical complexity for the large number of individual motors and can present problems in respect of their synchronization.

OBJECT AND ADVANTAGES OF THE INVENTION

The object of the invention is to provide a multiple-die press and, in particular, a large-part multiple-die press (LP-press), in which the transportation of parts can be effected both as a 3-axis transfer with grippers and as a 2-axis transfer with suction beams.

This object is achieved, by providing gripper-and-supporting rails, and a fastening means connected to each respective rail for the selective fastening of a cross-tie having a suction spider attached thereto, or a gripper element. The selected one suction spider and the gripper element engages the workpieces. Drive means are operatively connected to the advancement means, the lifting means, and the closing/opening means for causing a motion sequence to operate both the cross-tie and gripper element.

The invention is consequently based upon the core concept that the press exhibits structural measures which allow the press to be usable both in suction beam operation and in gripper operation.

The transport device according to the invention pursues the basic concept of a fully flexible handling through the transfer press of the workpieces or parts to be transported, in which case the driving, with respect to the longitudinal driving of the supporting or gripper rails, is intended to be effected either using a central drive, by means of push rods and cam gears which are switchable to the various sequences of motions, or using programmable individual drives.

According to the invention, the individual sequences of motions can be changed, so that a transfer can be effected both with suction beams and with grippers. In this instance, suitable means for the fastening both of cross-ties or suction beams for the 2-axis operation and of gripper elements for the 3-axis operation have to be provided. Use is further made of an additional transverse transport unit, which, besides the transversely running closing/opening motion, is also able to perform the lifting motion for the supporting or gripper rail. The closing box, which is usually disposed beneath the supporting or gripper rails, for performing the lifting and closing motion, is consequently replaced by a transport system disposed above the supporting or gripper rails, which transport system is able to perform the corresponding motions as and when required.

From EP 0 384 188 B1, a transport device for a transfer press or the like has admittedly become known, in which the supporting rails running through the press can likewise be raised by means of a lifting device disposed above the supporting rails. This arrangement relates solely however to a 2-axis drive having cross-ties disposed between the supporting rails, so that the lifting device serves solely to perform the vertical motion of the gripper rails. The longitudinal motion continues to be conducted, as before, by a frontal central drive. The same applies to the lifting motion, which is likewise effected centrally for all lifting devices by means of a push rod drive.

The transport device according to the invention consequently has the advantage that an extremely flexible arrangement is created, which can be used without difficulty both in suction beam and in gripper operation. This object is served by the additional transverse transport units disposed above the supporting or gripper rails and having, respectively, an integrated lifting column from which the respective supporting or gripper rail is suspended, so that the conventional lifting and closing motion can solely be executed by this separately drivable transverse transport unit. The lifting and transverse motions can herein be performed by corresponding drives in mutual isolation, the transverse motion, in particular, being configured as a production axis and/or as a set-up axis.

The supporting and gripper rails are mounted on the respective transverse transport unit, by means of an associated lifting column, in a slide guide, so as to enable the transverse transport unit to be placed stationary, preferably between the uprights of a press, within an empty stage.

The configuration of the transverse motion of the lifting column in an associated supporting slide as part of the transverse transport unit is advantageous, various drive systems being provided both for the lifting column and for the transversely running supporting slide. In a preferred configuration, this drive can be effected by means of a traction mechanism arrangement, preferably comprising a belt drive or the like. In place of a traction mechanism arrangement, a spline shaft with pinion and rack can also be present to perform the lifting motion and, as a spindle/nut drive, to perform the transverse motion, the drives of the various drive members being configured as high-precision programmable drives. A belt drive of this kind for performing an independent lifting motion and transverse motion is defined, for example, from the aspect of the working principle, in DE 32 33 428 C2.

The peculiarity of the present invention accordingly lies, in particular, in the problem-free convertibility of the transport device for a 2-axis longitudinal transfer with suction beams and a 3-axis transfer with gripper elements. For this purpose, the supporting or gripper rails are provided with special receiving apparatuses or receiving flanges, which alternatively can be fitted to receive cross-ties and suction beams or the like, or can be fitted with gripper bars having corresponding gripper elements. It is herein preferably provided that the receiving apparatus for the cross-ties and/or the gripper elements should be mounted in longitudinally displaceable arrangement on the supporting or gripper rails so as to be able to execute part-steps in a motion relative to the supporting or gripper rail, in order, in particular in 2-axis transfer, to transport the cross-ties into a parking setting between the die stages. Particularly advantageous in this context is the refinement of this receiving apparatus to the effect that a swivel motion about a horizontal transverse axis is also able to be performed, thereby enabling the cross-ties and/or the gripper elements to be swiveled about their preferably horizontal longitudinal axis.

Further advantages and details of the invention are derived from the description and the appended associated drawings. The above-stated features and those yet to be described below can herein be used not only in the respectively defined combination, but also in other combinations or in isolation, without departing from the framework of the present invention.

BRIEF DESCRIPTION OF THE DRAWINGS

Various illustrative embodiments of the invention are represented in the drawing and are explained in greater detail in the following description, wherein, in the individual figures.

FIG. 13a shows a section along the sectional line A–B in FIG. 9a;

FIG. 13b shows a section along the sectional line E–F in FIG. 13a;

FIG. 14a shows a section along the sectional line C–D in FIG. 11a; *and*

FIG. 14b shows a section along the sectional line G–H in FIG. 14a.

DETAILED DESCRIPTION OF THE INVENTION

Figure 1:
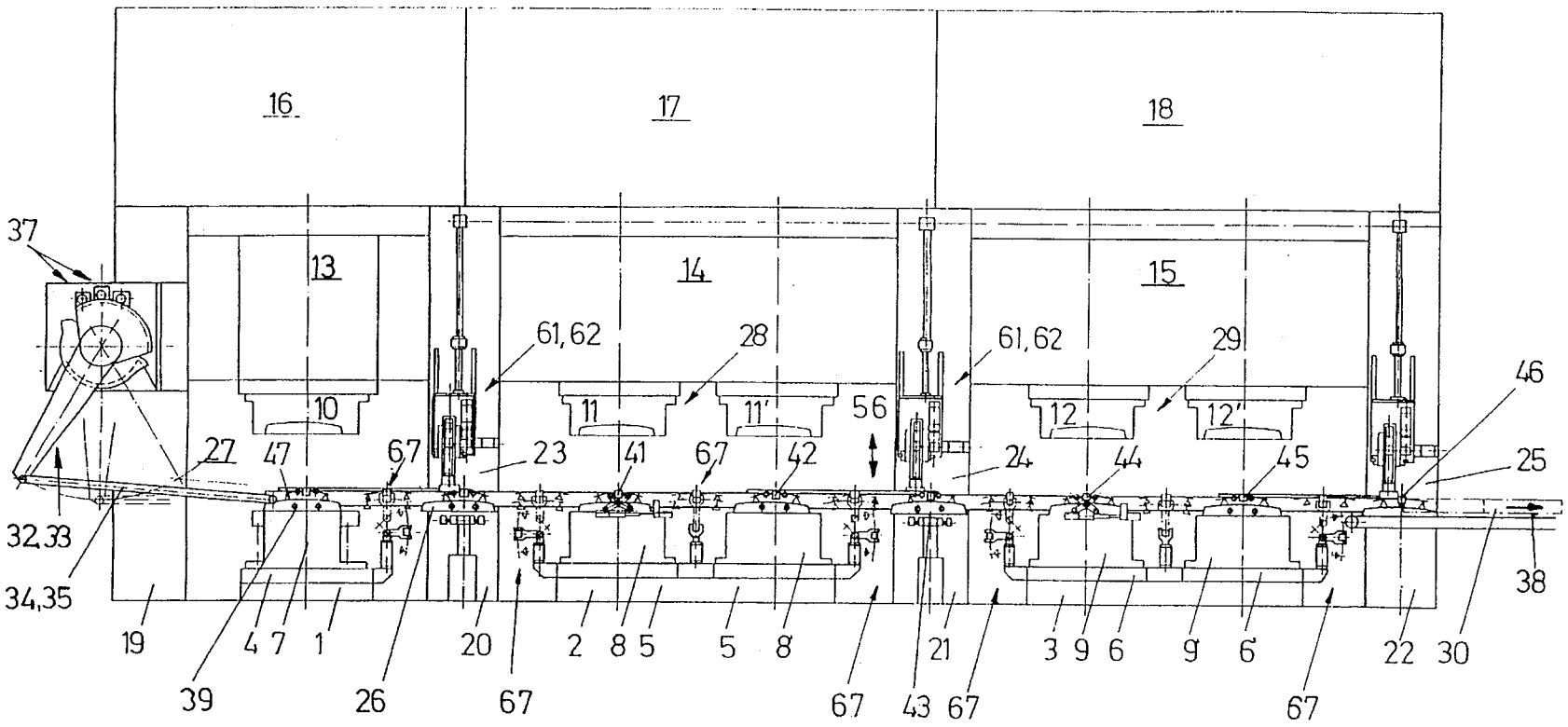
FIG. 1 shows a longitudinal section through a large-part multiple-die press (LP-press) in 2-axis operation with cross-ties in the withdrawal setting.
Figure 2:
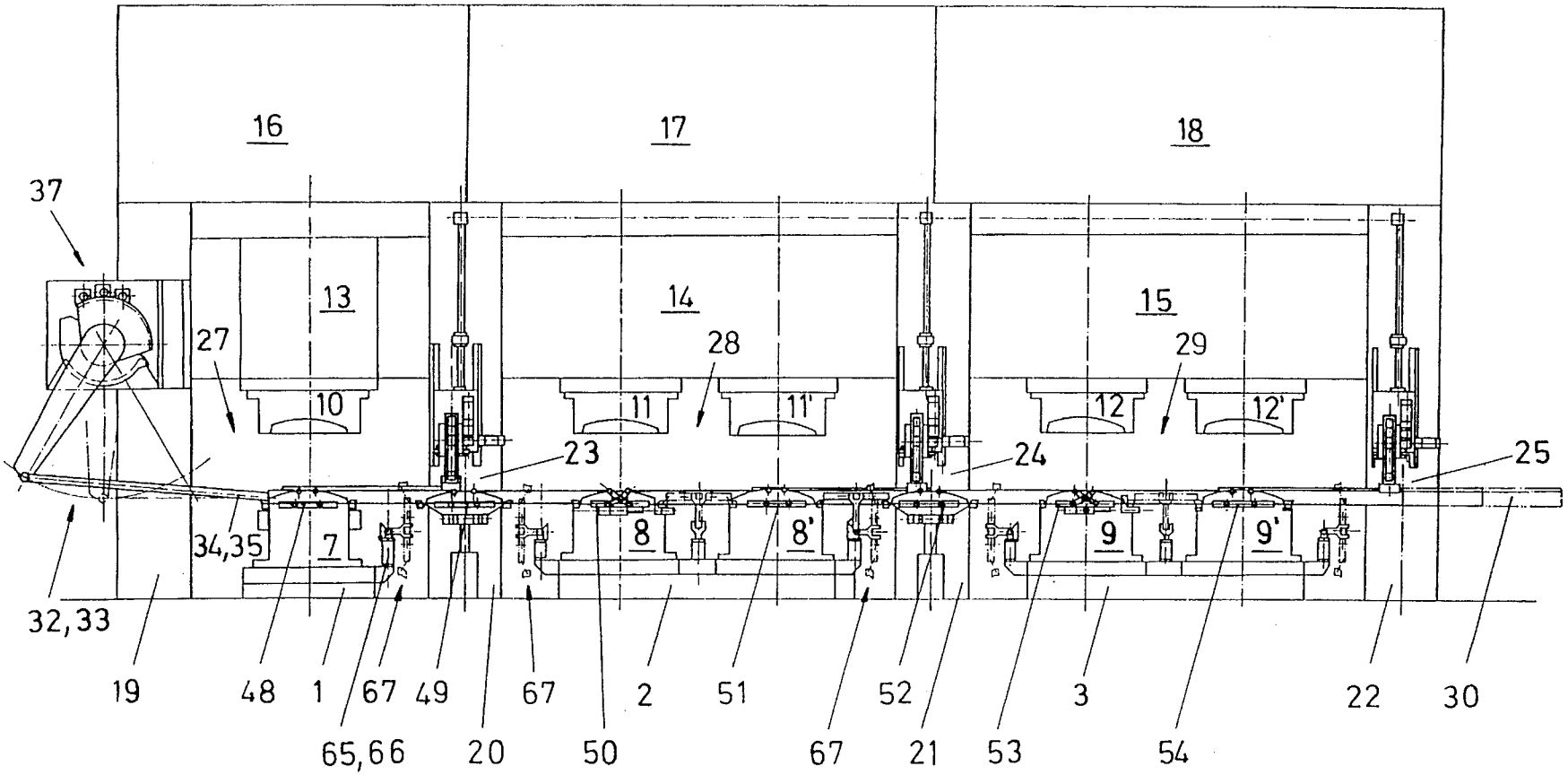
FIG. 2 shows a longitudinal section through a LP-press in 3-axis operation with gripper in the withdrawal setting.
Figure 3:
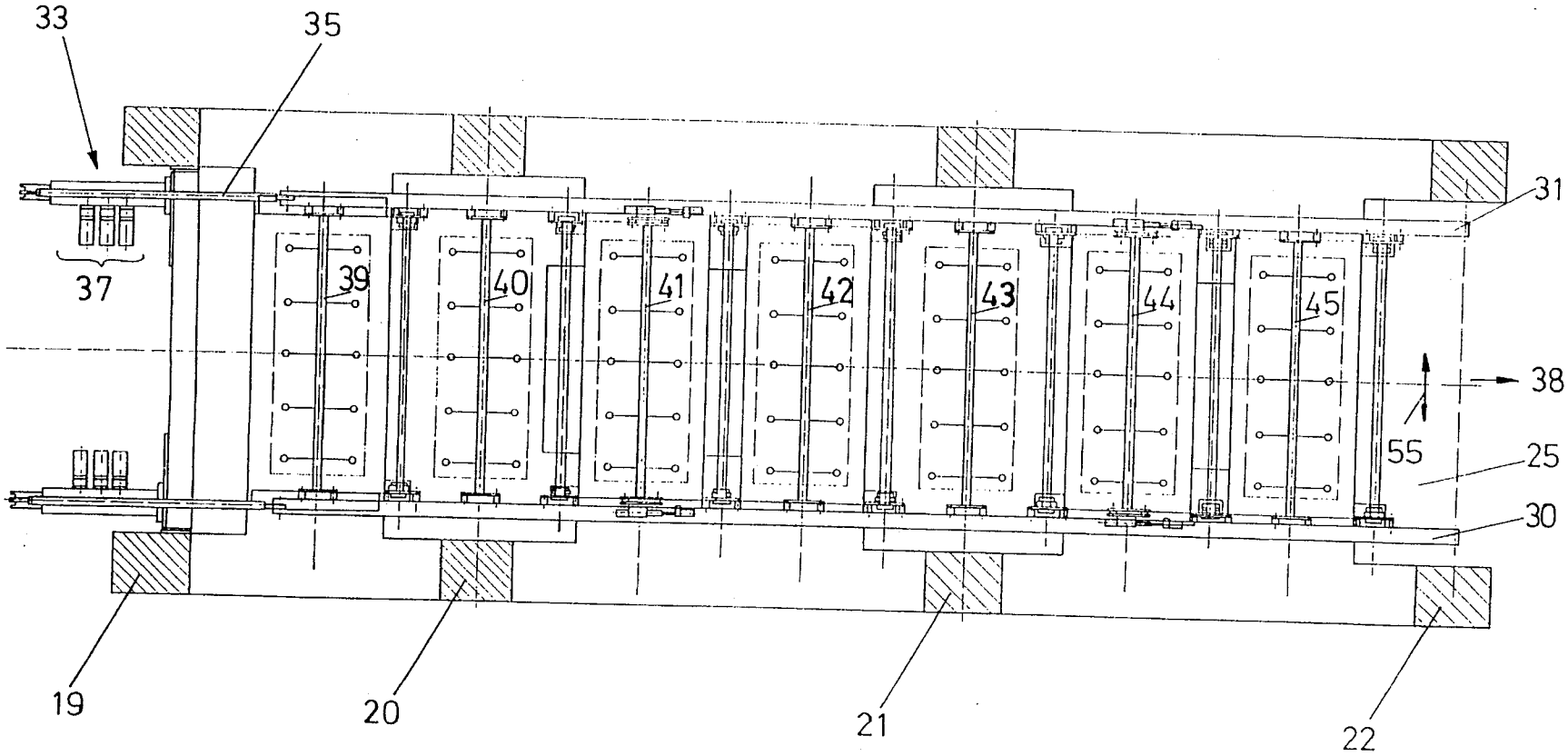
FIG. 3 shows a top view of the LP-press according to FIG. 1.
Figure 4:
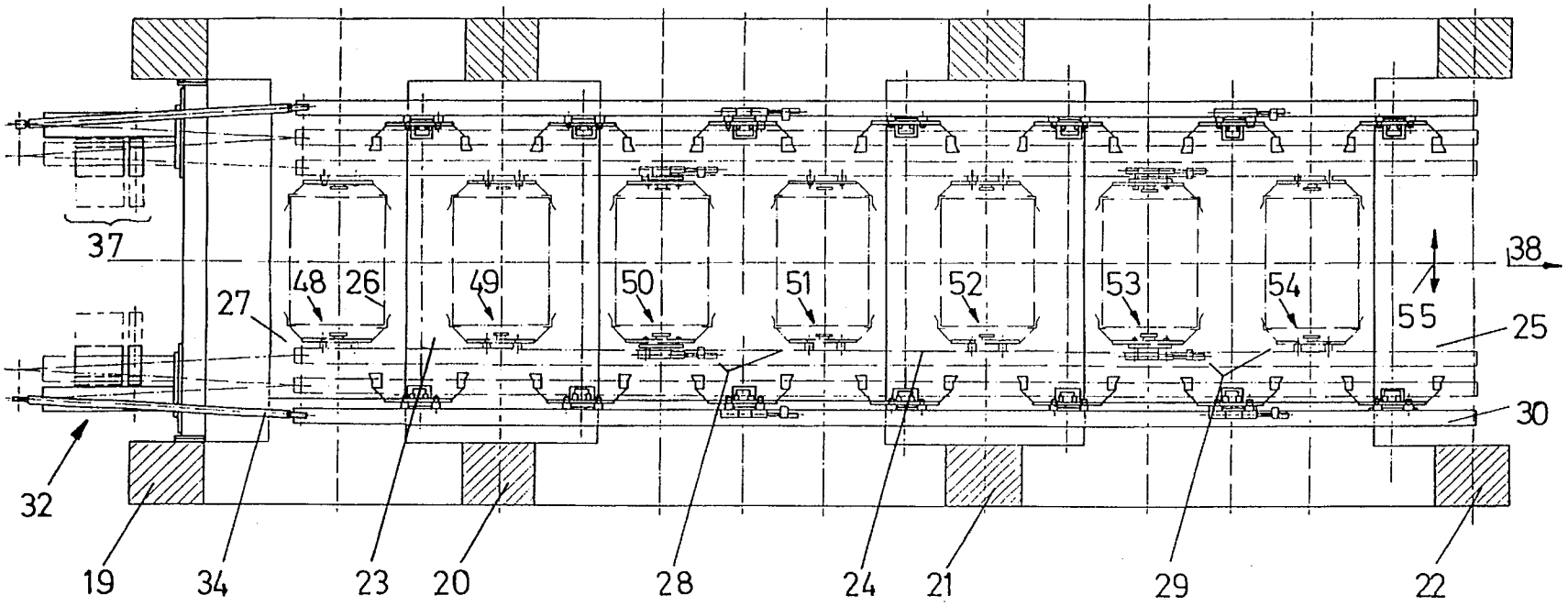
FIG. 4 shows a top view of the LP-press according to FIG. 2.

In FIGS. 1 and 2 there are represented five machining stages of a large-part multiple-die press (LP-press) in side view and longitudinal section respectively, the associated top views being represented in FIGS. 3, 4. The multiple-die press respectively exhibits press platens 1 to 3 and above-lying sliding tables 4 to 6, with thereon fastened bottom dies 7 to 9. In the upper part of the multiple-die press there are located the top dies 10 to 12 and the press rams 13 to 15. The top beams or headpieces 16 to 18 are connected to the press platens 1 to 3 by the press uprights 19 to 22, between which the press rams 13 to 15 too are guided.

In the LP-multiple-die presses represented in FIGS. 1 to 4, the press rams 14, 15 are configured as so-called "double rams", i.e. on each ram 14, 15 there are located two top dies 11, 11' and 12, 12', to which there are respectively assigned two associated bottom dies 8, 8' and 9, 9'.

In the upright region of the press uprights 20, 21, 22 et seq., there are respectively located so-called "empty stages" or "orientation stages" 23 to 25, in which the machined workpieces 26 are deposited between the machining stations 27 to 29 et seq. The position of the workpiece can herein be altered in this orientation station for the next machining step. Due to the double-ram configuration, the two machining stations 28, 29 in turn comprise two individual stations, which are started up one after the other.

According to the representation in FIGS. 1, 2 in side view and FIGS. 3, 4 in top view, running through the whole of the large-part multiple-die press there are two supporting or gripper rails 30, 31, which are disposed laterally in the region of the uprights 19 to 22 and are driven by a feed drive 32, 33 by means of a respective push rod 34, 35. The feed drive 32, 33 comprises a programmable drive with toothed segment 37. It is also however possible (as not explained in greater detail) for a number of cam disks to be provided, which can be switched to the various motions and are synchronously driven, in a known manner, by the press drive.

The peculiarity of the invention now lies, inter alia, in the fact that the supporting or gripper rails 30, 31 are able to perform a 2-axial or 3-axial motion, so that different press systems are realized within a single press. Thus, FIG. 1 shows in side view, and FIG. 3 in associated top view, a 2-axial press system offering a 2-axial motion of the supporting rails 30, 31 (with cross-ties) in the longitudinal direction (arrow 38) and in the vertical direction (arrow 56).

In contrast to the above, the illustrative embodiment according to FIG. 2 shows in side view, and according to FIG. 4 in top view, a press system having a 3-axial system of motion, in which the gripper rails 30, 31 can perform with grippers, transversely to the longitudinal direction 38 of the press, an additional transverse motion compared with the 2-axis system, in order to handle the workpieces.

In the 2-axis system represented according to FIGS. 1 and 3, with production axes aligned in the longitudinal direction of the press and in the vertical direction, the two supporting rails 30, 31 exhibit cross-ties 39 to 46 connecting them, which cross-ties are found in each machining stage and empty stage of the press system and to which so-called "suction spiders" 47 for receiving the workpiece are fastened.

For a 3-axis drive, the two longitudinal transfer rails 30, 31 exhibit, in place of the cross-ties 39 to 46 with thereto fastened suction spiders 47, gripper elements or gripper holders 48 to 54 on gripper bars, as is represented in FIG. 2 in side view and in FIG. 4 in top view. In this embodiment, the cross-tie is consequently absent, so that the gripper rails 30, 31 perform a 3-axial motion, i.e in addition to the longitudinal and lifting motion of the gripper rails, a transverse motion in the longitudinal direction of the press is performed (arrow 55) to enable the gripper elements 48 to 54 to grip the workpiece, transport it and deposit it in the next die stage.

The sequence of motions of the gripper rail of the 3-axis transfer is as follows:

closing with a transverse motion in order to grip the workpiece by means of the gripper elements;

raising of the workpiece;

transportation of the workpiece;

lowering of the workpiece in a subsequent die stage;

opening, i.e. transverse motion outwards of the gripper elements;

return to the starting position.

The closing or opening motion of the gripper elements in the transverse direction allows them always to be removed laterally from the press chamber as the working stroke is performed.

The sequence of motions in the case of 2-axis transfer by means of cross-ties or suction beams is effected partially in half-stroke steps, since the cross-ties, during the machining cycle, must be "parked" in an intermediate setting or holding position between the dies. The sequence of motions is therefore as follows:

return half a stroke towards the workpiece to be received;

lowering of the suction spider onto the workpiece;

raising of the workpiece;

transportation of the workpiece in a full transport step, accompanied by lowering and depositing of the workpiece;

raising of the empty suction spider, and return half a stroke into the "parking setting".

The motional cycles of the 2-axis and 3-axis system as production axes are known and are explained in greater detail in the publications mentioned in the introduction.

Figure 5A:
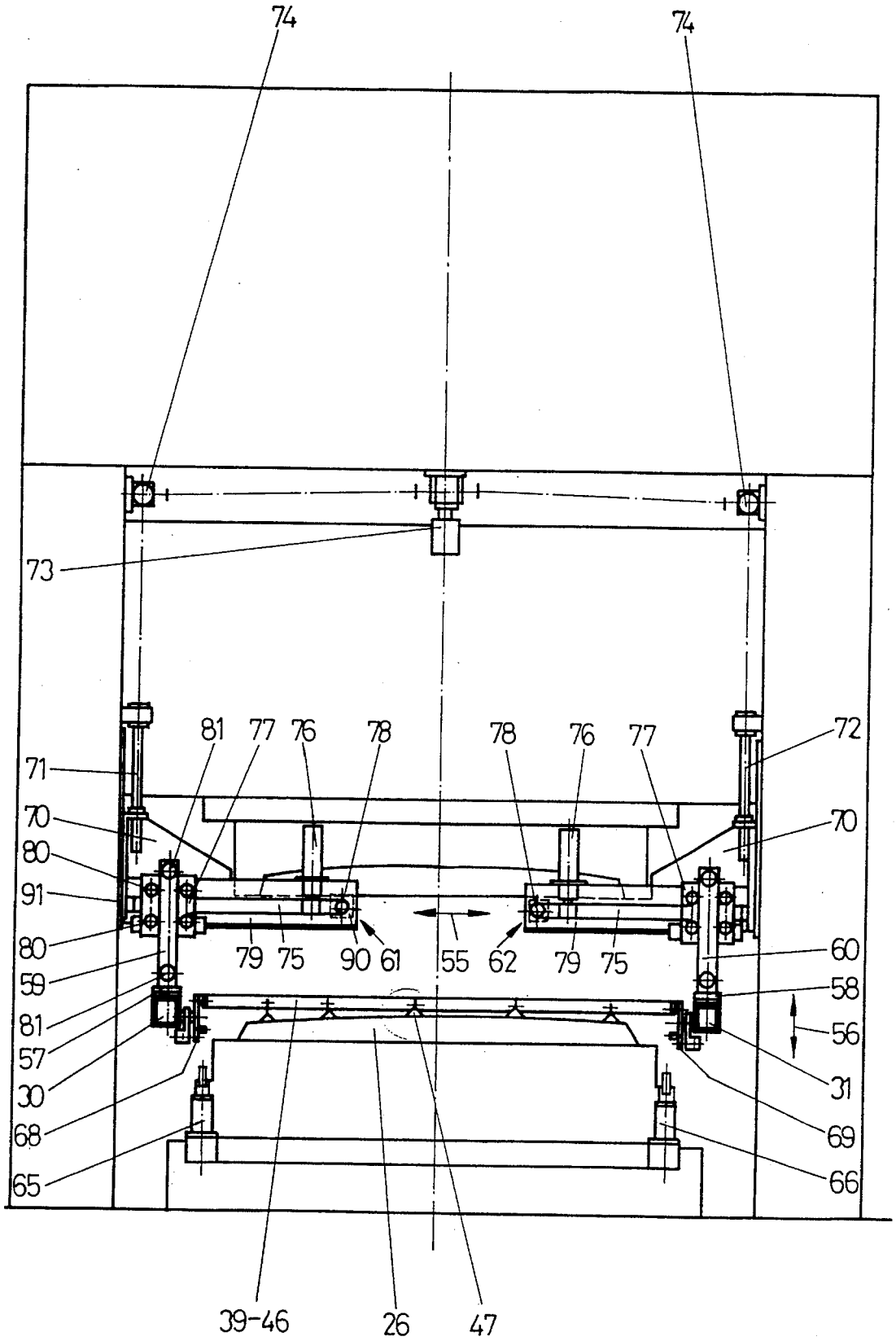
FIG. 5*a* shows a front view in the throughput direction through the LP-press in 2-axis operation with cross-tie in the withdrawal setting, exhibiting a first embodiment of a lifting/closing transport unit having a traction mechanism drive.
Figure 5B:
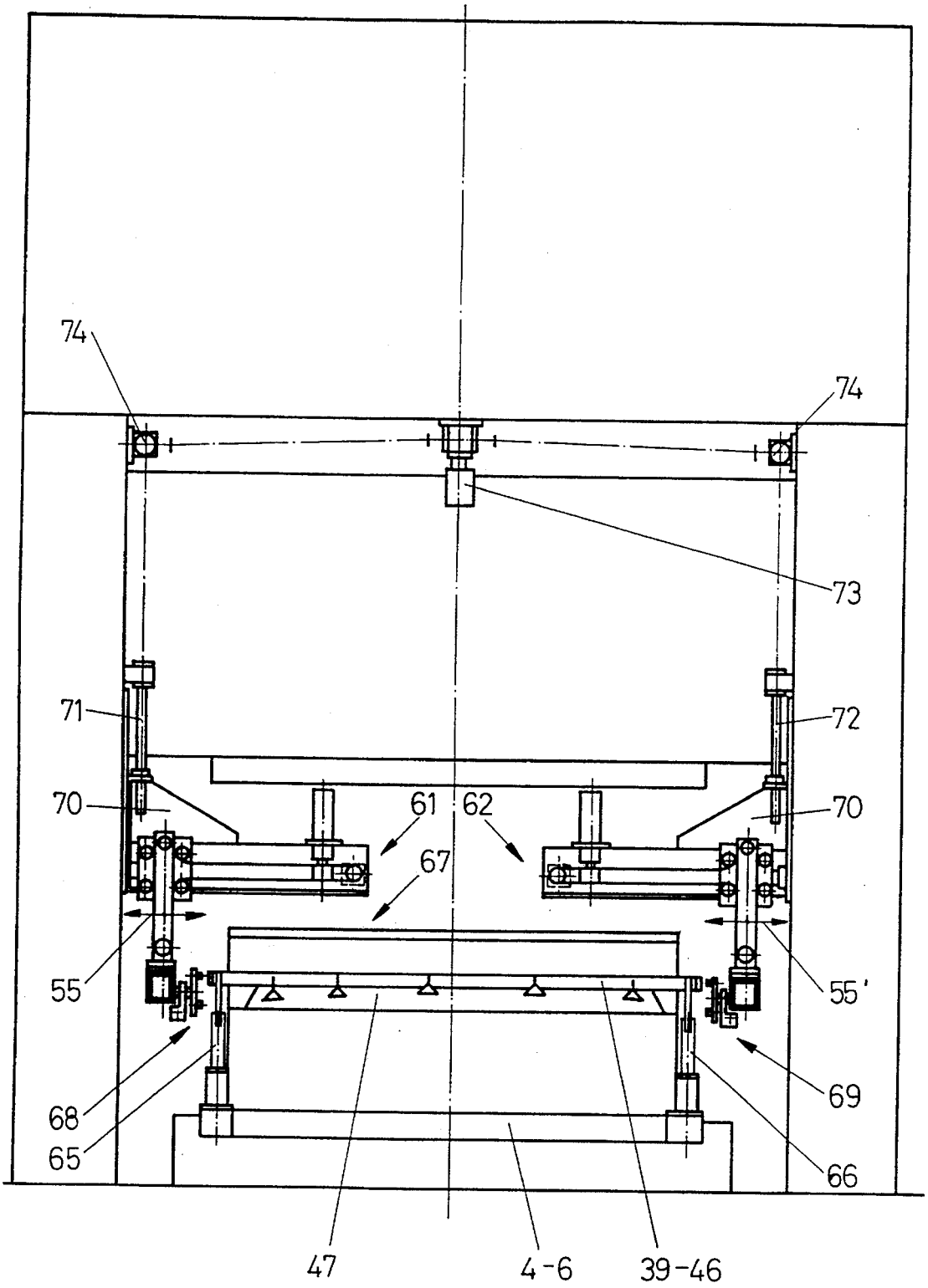
FIG. 5*b* shows a representation according to FIG. 5*a*, but in the pegging setting of the cross-tie for conversion purposes.
Figure 5C:
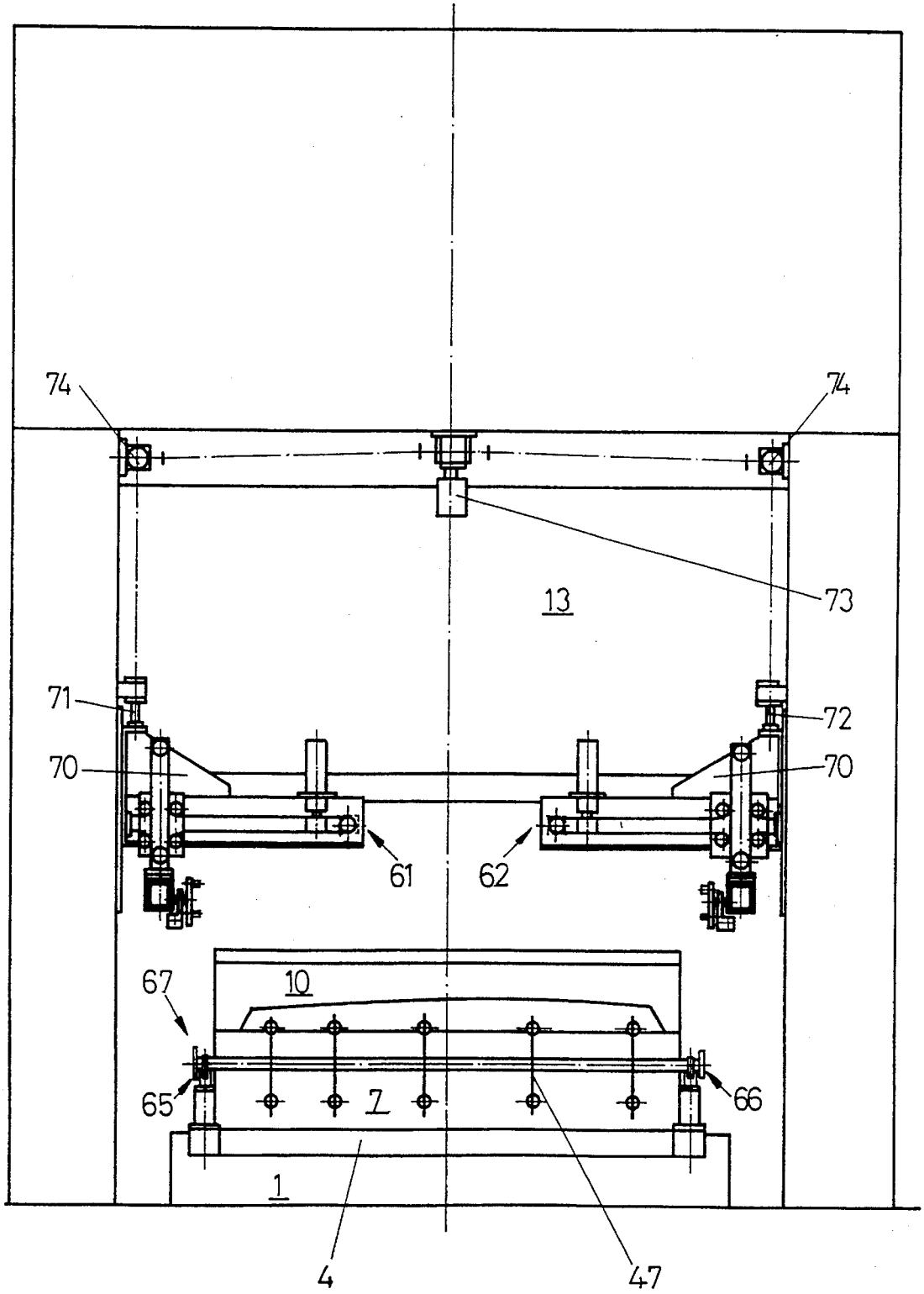
FIG. 5*c* shows a representation according to FIG. 5*a*, but with hoisted transport unit, inclusive of supporting rails and laterally swiveled-away cross-tie, on the sliding table.

In FIGS. 5*a* to 5*c* there is represented a first drive system for the supporting rails 30, 31 working in 2-axis operation, between which there is located a cross-tie 39 to 46 with a thereto fastened suction spider 47 for receiving a workpiece 26. The supporting rails 30, 31 consequently perform only a longitudinal motion aligned in the longitudinal direction 38 of the press and a vertical lifting motion 56. For this purpose, the supporting rails 30, 31 are connected in a first embodiment, by longitudinal guide slides 57, 58, to a lifting column 59, 60 of an additional transverse transport unit 61, 62. This transport unit 61, 62 serves in this case, in order to perform the lifting motion of the supporting rails 30, 31, as a production axis, i.e. during the machining of the workpiece. In the case of the so-called "2-axis drive", a transverse motion transversely to the longitudinal direction of the press, in accordance with arrow 55, as a production axis, i.e. during the machining, is not necessary, since the distance between the two supporting rails 30, 31 remains unchanged throughout the transport cycle. In the 2-axis system in accordance with the representation according to FIG. 5*b*, a transverse motion may also however be necessary for the conversion of the system (set-up axis), so as to enable a decoupling and subsequent pegging of the cross-tie 39 to 46 onto associated pegging holders 65, 66 on the sliding tables 4 to 6. This transverse motion as a set-up axis for the decoupling of the cross-ties is represented in FIG. 5*b* with the reference symbol 55'.

According to the representation according to FIG. 5*c*, the cross-tie with suction spider, which is pegged on pegging holders 65, 66 having associated receiving bolts, can further be swiveled by 90° next to the sliding table in order to obtain a simpler withdrawal position for the exchange parts. In FIG. 1, alongside the respective bottom dies 7 to 9, the pegging holders of the one press side are represented in a pegging position 67, with a suction spider which is respectively horizontal and is swiveled by 90°. The horizontal setting of the suction spider 47 is shown by FIG. 5b, while the 90°-swiveled suction spider 47 is represented in FIG. 5*c*.

Between the cross-ties 39 to 46 and the supporting rails 30, 31 there are special receiving apparatuses and, in particular, receiving flanges 68, 69, which are yet to be explained in greater detail.

From FIGS. 5*a* to 5*c*, there can further be seen an additional vertically adjustable bracket 70, on which the transverse transport unit 61, 62 is mounted in vertically displaceable arrangement. This vertical adjustment serves as a set-up axis for the die-change. For this purpose, this vertical adjustment mechanism exhibits a spindle 71, 72, which is driven by a common vertical adjustment drive 73 having a corresponding deflection gearing 74 for the purpose of a vertical adjustment of the transport units 61, 62. In FIG. 5*c*, the transport unit 61, 62 is in the uppermost setting, i.e. the sliding table 4 with bottom die 7 and mounted top die 10 is able to be transported out of the press chamber without difficulty.

The transverse transport units 61, 62 represented in FIGS. 5*a* to 5*c* can exhibit a variety of drive systems, a belt drive, i.e. a traction mechanism drive, being chosen in FIGS. 5*a* to 5*c*. A drive system of this kind has basically become known, for transportation of a workpiece, from DE 32 33 428 C2, which has already been mentioned in the introduction. The disclosure of this patent specification is incorporated within the present application expressly to provide description of this drive system.

According to this drive system, each transport unit 61, 62 exhibits a first, horizontally circulating belt 75, which drives, by means of a drive motor 76, a slide 77 for the closing/opening motion, which slide is displaceable in the direction of the transverse axis 55. A further, end-side drive motor 78 with drive roller 90 serves to drive a deflection belt 79 fastened on the other side 91 of the transport unit, which deflection belt is guided by means of four deflection rollers 80 in the slide 77 and by means of a further two deflection rollers 81 in the lifting column 59, 60. Where the deflection belt 79 is driven by means of the drive 78 in a certain direction, then the belt is lengthened or shortened within this strand, so that the lifting column 59, 60 moves up or down depending upon the motional direction of the deflection belt, i.e. is put into the lifting motion 56.

Figure 6A:
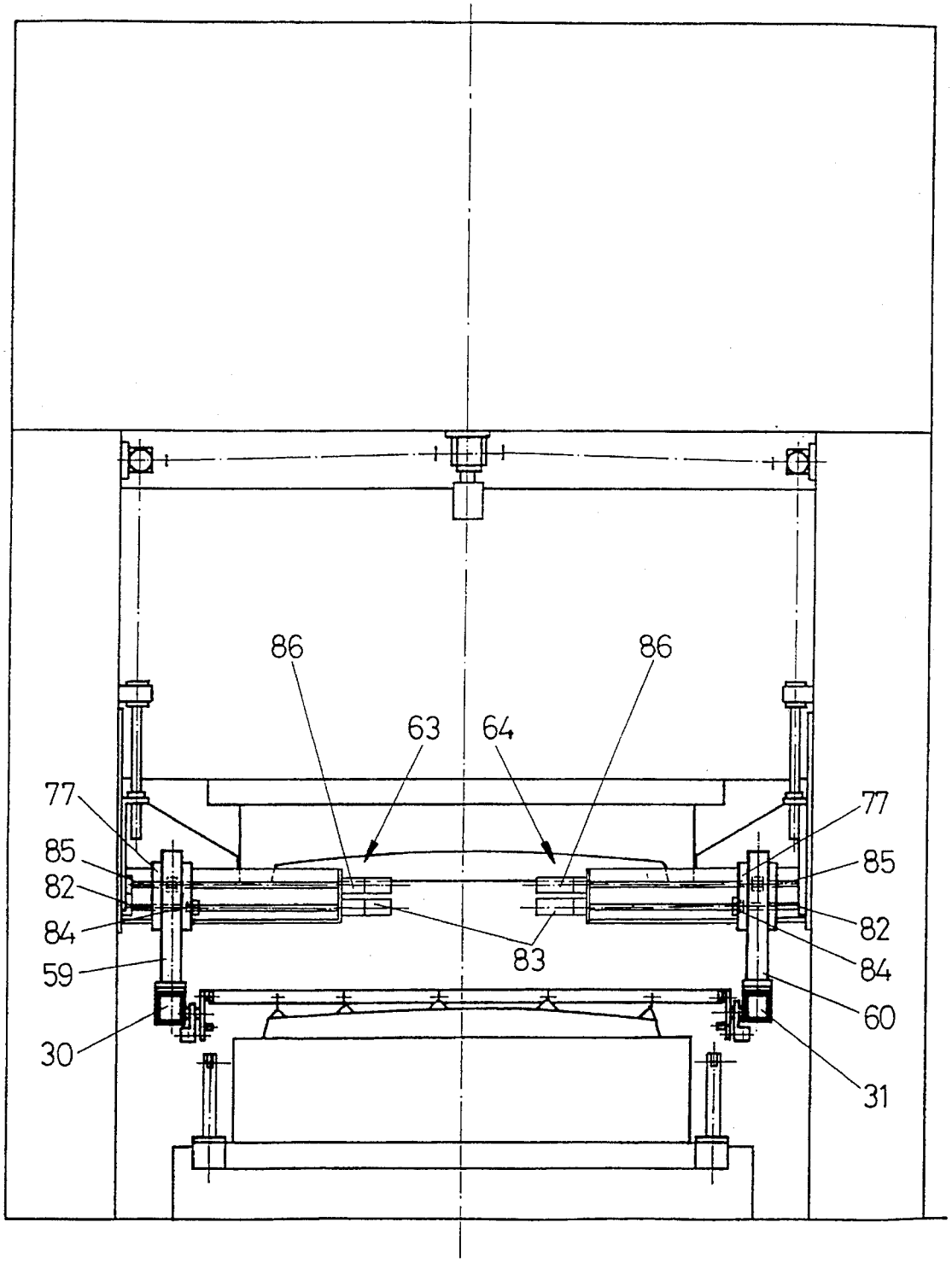
FIGS. 6*a*–6*c* show a representation according to FIGS. 5*a*–5*c*, but exhibiting an alternative embodiment of a lifting/closing transport unit with spindle drive.
Figure 6B:
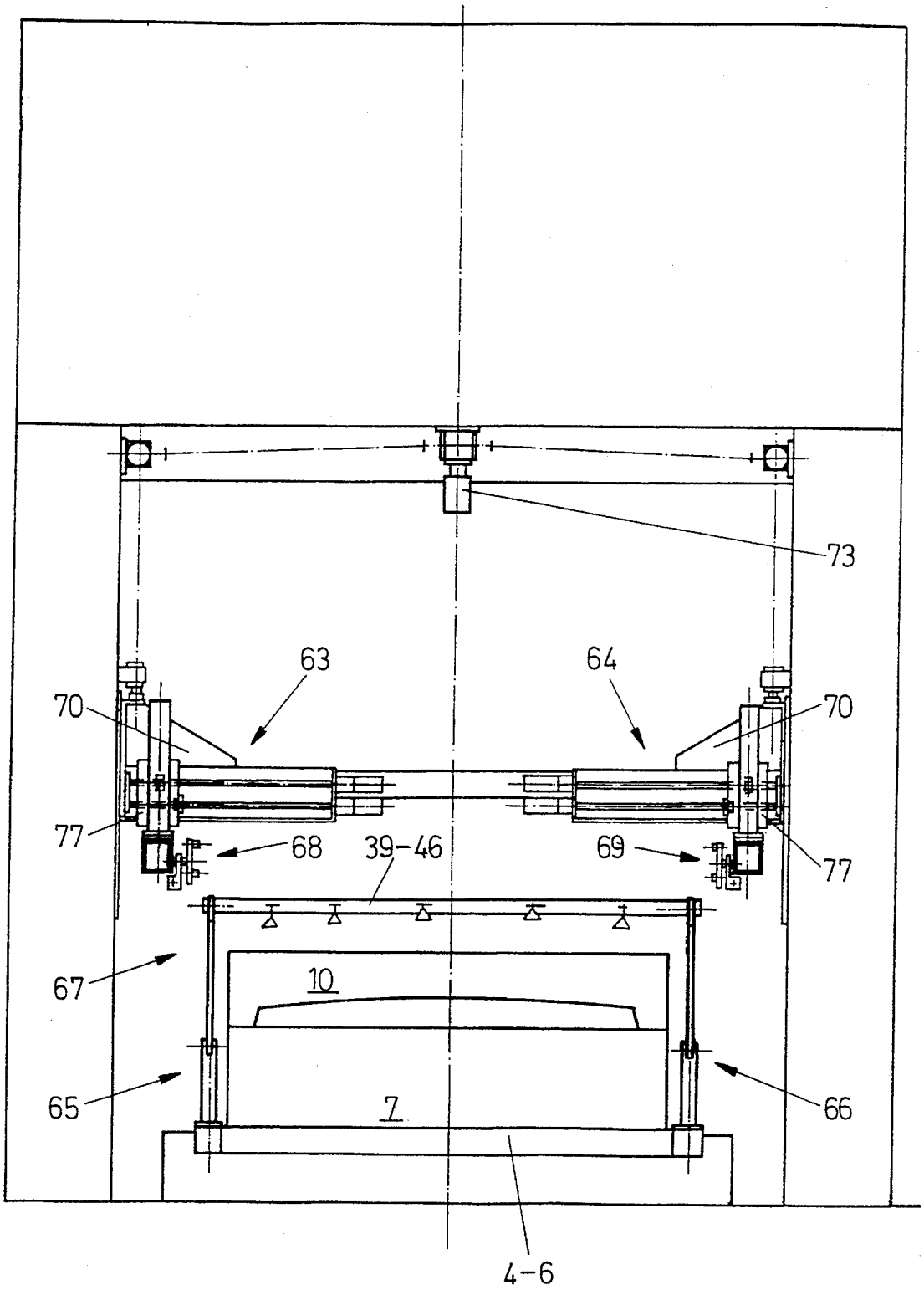
Figure 6C:
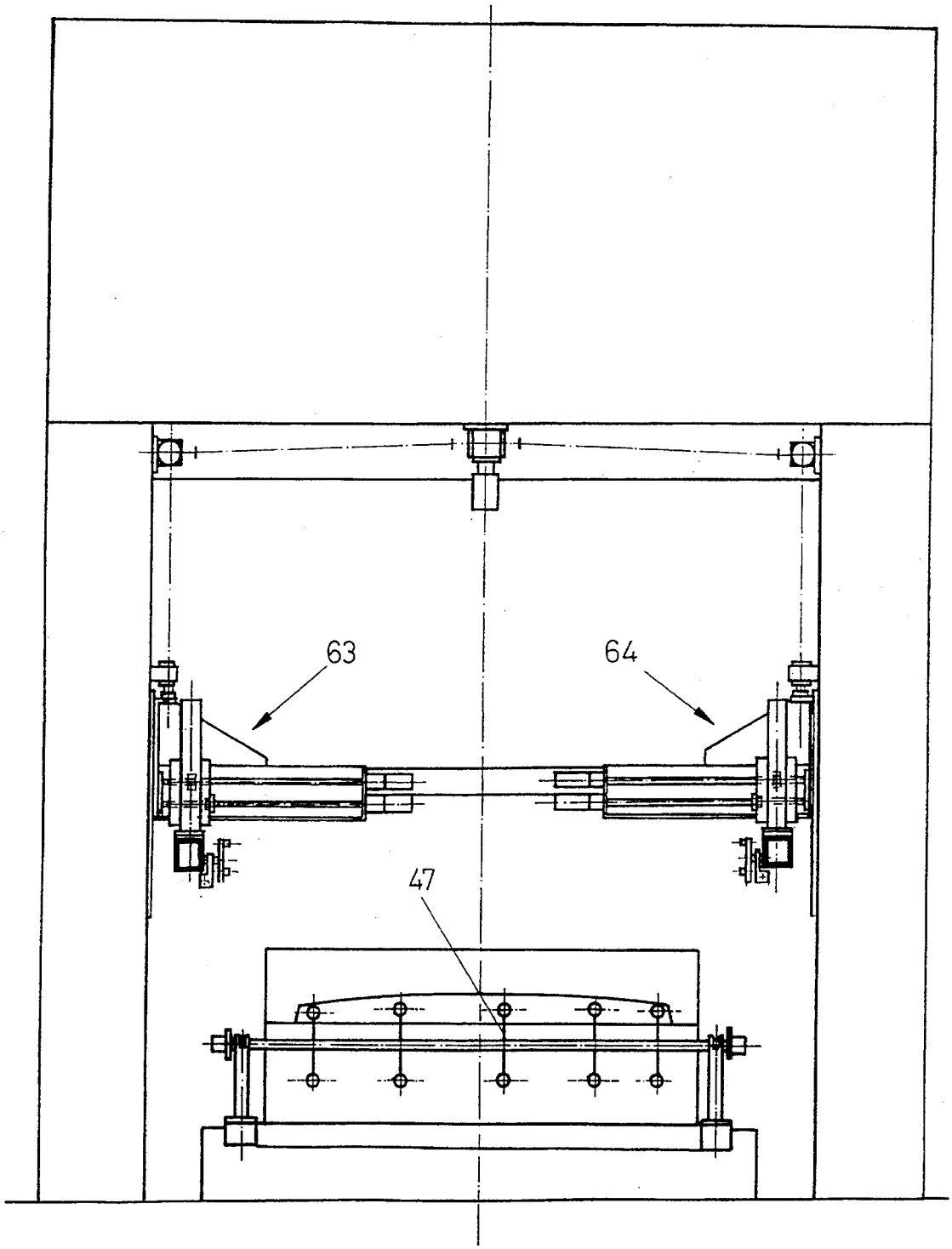

The further illustrative embodiment of the invention according to FIGS. 6*a* to 6*c* shows an alternative transport unit 63, 64, which, in place of the belt drive or cable drive of the transport device 61, 62 in FIGS. 5*a* to 5*c*, exhibits a spindle drive 82. For this purpose, a spindle drive motor 83 is provided for the spindle 82, which spindle interacts with a spindle nut 84 on the slide 77 to perform the transversely directed closing/opening motion.

By means of, for example, a spline shaft or sliding ball shaft 85 with pinion and rack, the lift drive of the lifting column 59, 60 is effected by means of the lift drive motor 86.

The motors 76, 78 and 83, 86 of the transport units 61 to 64 are configured as high-precision drive motors, which allow, in their motions, programmable sequences of motions. For the realization of the spindle drives, for example, programmable electric or hydraulic servo motors 83, 86 are provided.

The representation according to FIGS. 6*b* and 6*c* corresponds basically to the described representation according to FIGS. 5*b* and 5*c*, but with the alternatively configured transport unit 63, 64. Thus, in FIG. 6*b*, the cross-tie 39 to 46 is pegged on the pegging holders 65, 66 in a pegging position 67 and the transport units 63, 64 are run upwards, by means of the vertically adjustable brackets 70, in order to be converted. In the representation according to FIG. 6*c*, the suction spider 47 is disposed swiveled by 90°.

The representation of the invention according to FIGS. 7 and 8 shows illustrative embodiments for a 3-axis drive, i.e. in this case, the gripper rails 30, 31 perform, besides the longitudinal motion (arrow 38 in FIG. 4) directed in the longitudinal direction of the press and the lifting motion 56, additionally a transverse motion 55. In this case, between the gripper rails 30, 31, there are no cross-ties fixing their spacing, but instead the receiving flanges 68, 69 on the gripper rails 30, 31 support the gripper elements 48 to 54, described with respect to FIGS. 2 and 4.

The transport unit 61 to 64 enables the 2-axis transfer with cross-ties, as was described with respect to FIGS. 1, 3 and 5, to be converted without difficulty into a 3-axis transfer with gripper elements, since the transport unit 61 to 64, with its lifting column 59, 60 and its transversely transportable slide 77, itself takes care of the lifting motion and the closing and opening motion. For this purpose, the gripper rails 30, 31 are once again connected by means of longitudinal guide slides 57, 58 to the lifting columns 59, 60, so that all motions in all three axes are able to be performed independently from one another. The gripper elements 48 to 54 can perform the customary travel motions on the workpiece 26, as described in the introduction.

In the conversion of the large-part multiple-die press from the 2-axis to the 3-axis transfer, only the cross-ties have consequently to be replaced by the gripper elements or vice versa, the receiving flanges 68, 69 being prepared for this conversion.

Figure 7A:
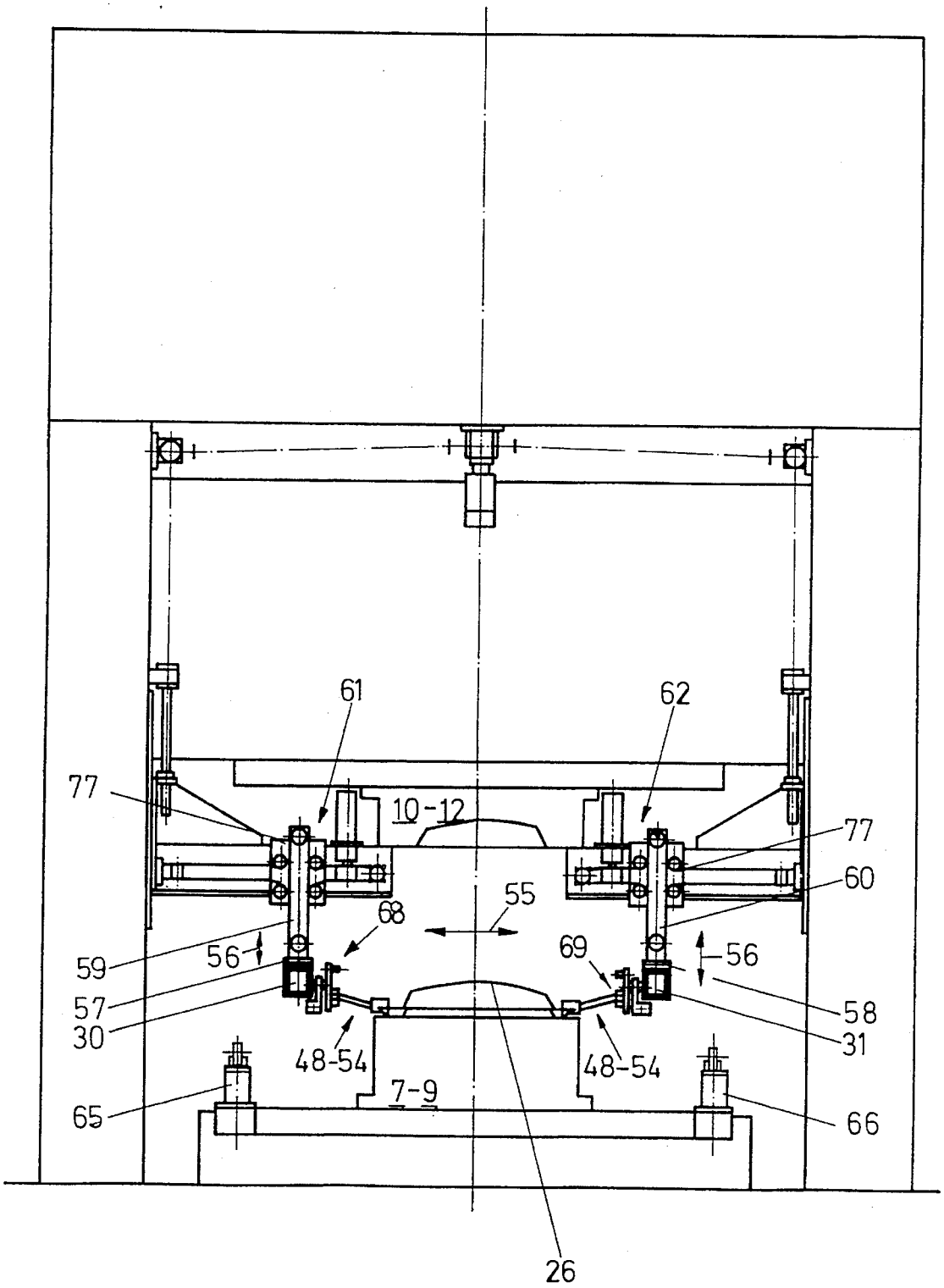
FIG. 7*a* shows a front view in the throughput direction of the LP-press in 3-axis operation with gripper in the withdrawal setting, exhibiting the first embodiment of the transport unit having a traction mechanism drive.
Figure 7B:
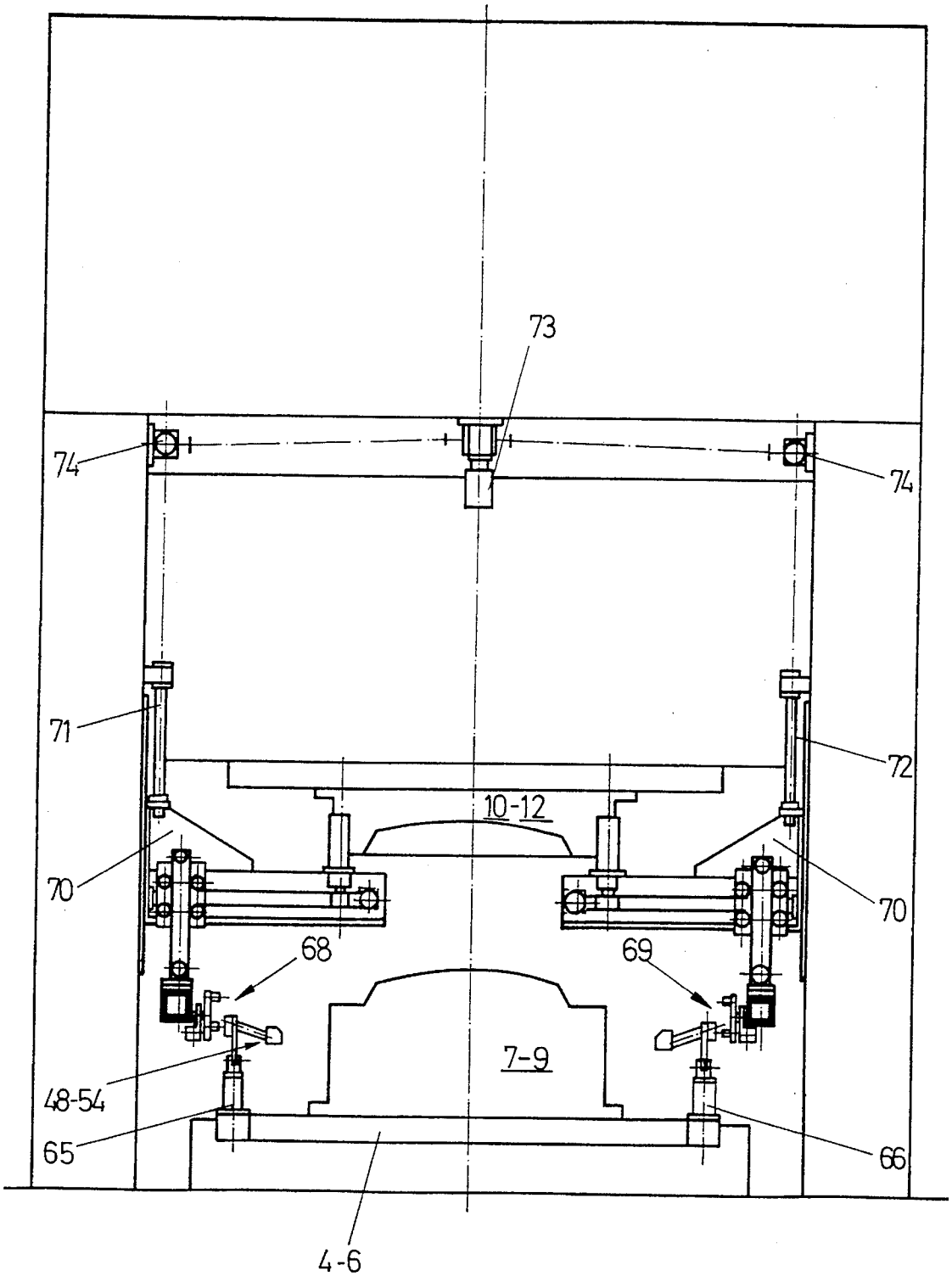
FIG. 7*b* shows the representation according to FIG. 7*a*, but in the pegging setting of the grippers for conversion purposes.

The representation according to FIG. 7*b* shows the arrangement according to FIG. 7*a* in the conversion cycle. For this purpose, in FIG. 7*b*, the gripper elements 48 to 54 are pegged onto the pegging holders 65, 66 on the sliding tables 4 to 6 and, for better die-change, according to the representation in FIG. 7c, swiveled by 90°. This pegging position 67 on the pegging holders 65, 66 is represented in FIG. 2 likewise with the reference symbol 67.

Figure 7C:
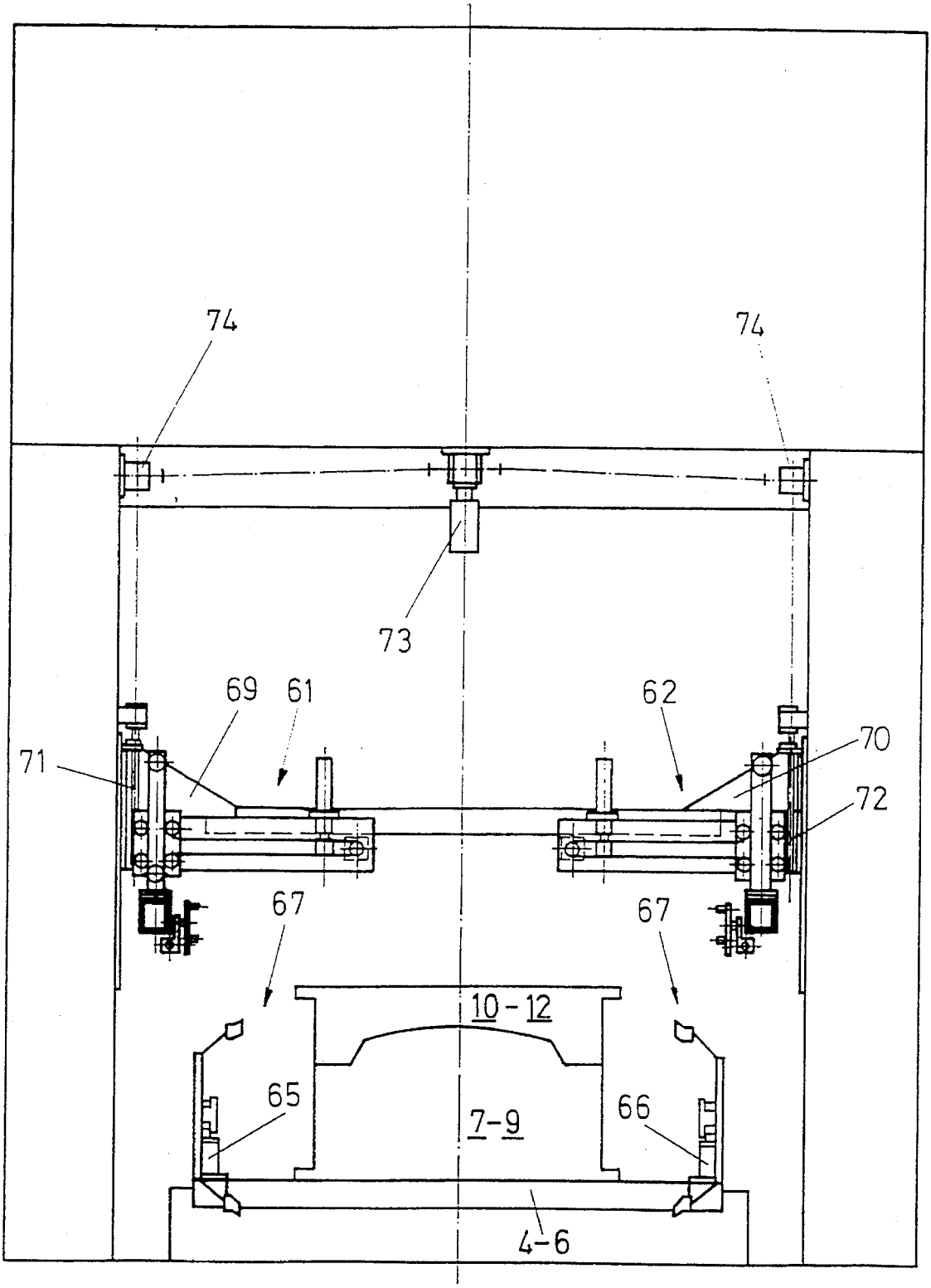
FIG. 7*c* shows the representation according to FIGS. 7*a*, 7*b*, but with swiveled-away grippers in the pegging setting and with hoisted set-up axis.

In FIG. 7*c*, moreover, in accordance with the representation according to FIG. 5*c*, the hoisted position of the two transport units 61, 62 on the vertically adjustable bracket 70 or on the spindles 71, 72 is shown as a conversion axis.

In FIGS. 7*a* to 7*c*, identical parts are therefore denoted by the same reference symbols as in FIGS. 5*a* to 5*c*.

Figure 8A:
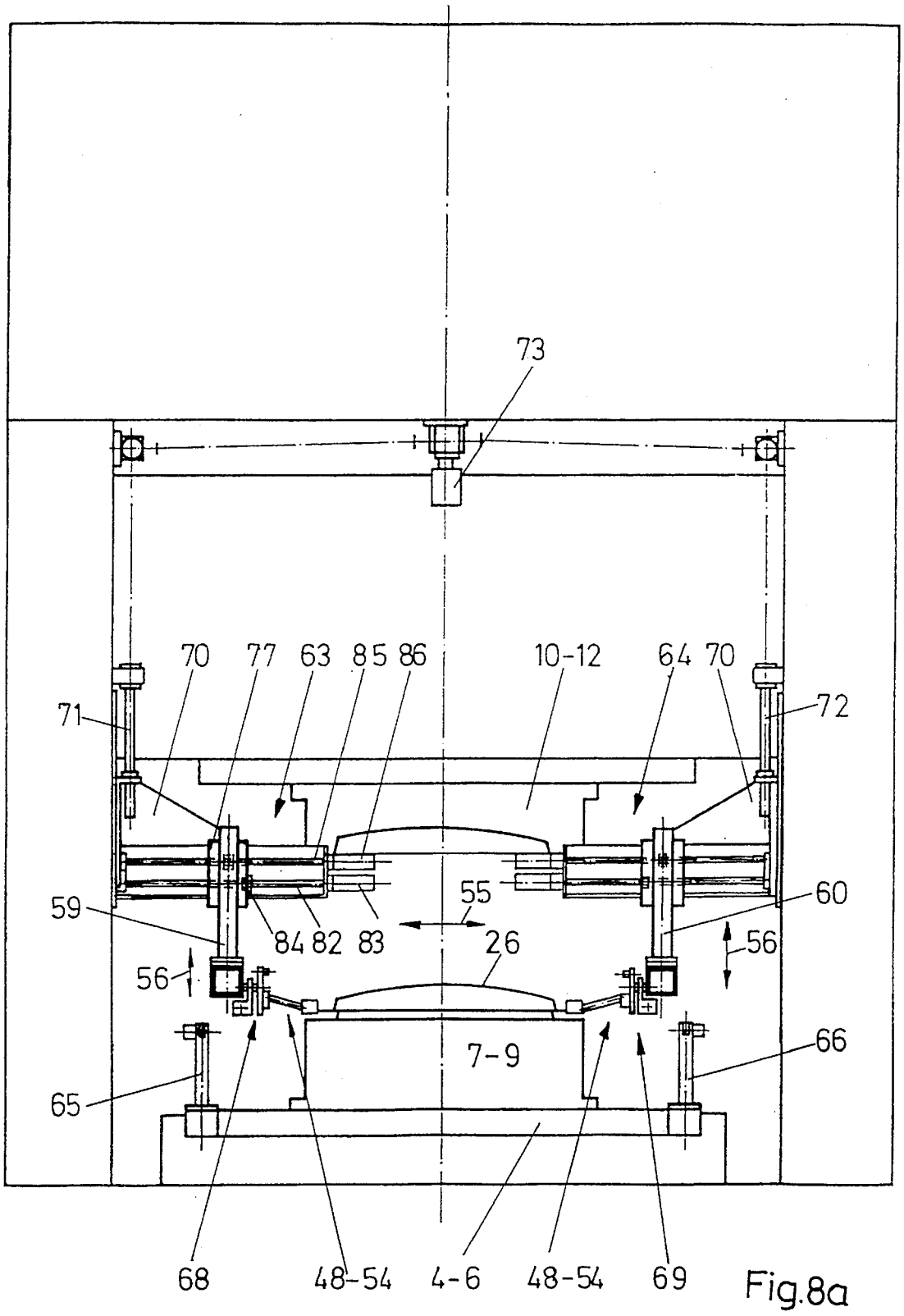
FIGS. 8a–8c show respectively a front view in the throughput direction of the LP-press in 3-axis operation with gripper, exhibiting a lifting/closing transport unit with spindle drive in various work settings, analogous to FIGS. *7a–7c;*
Figure 8B:
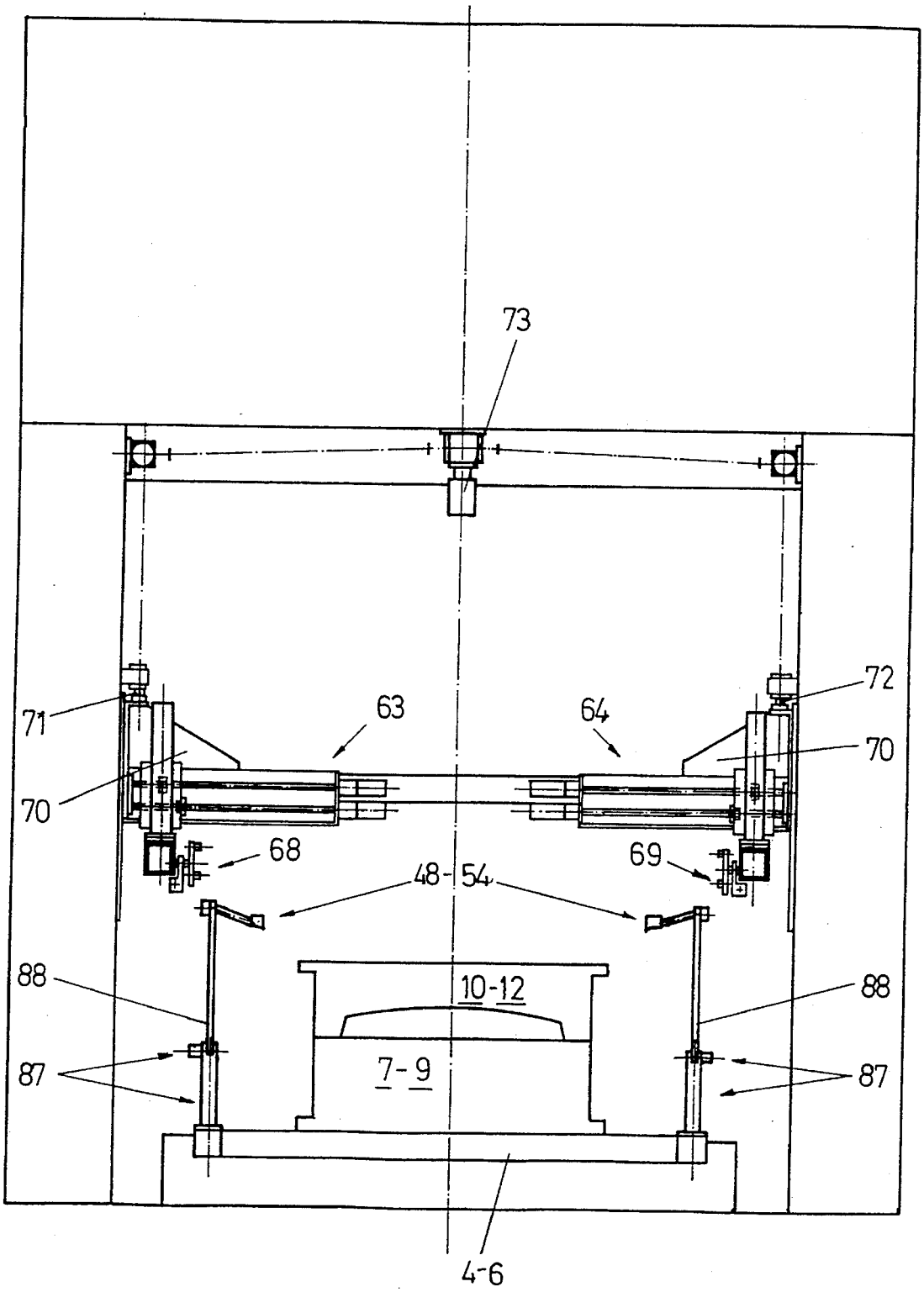
Figure 8C:
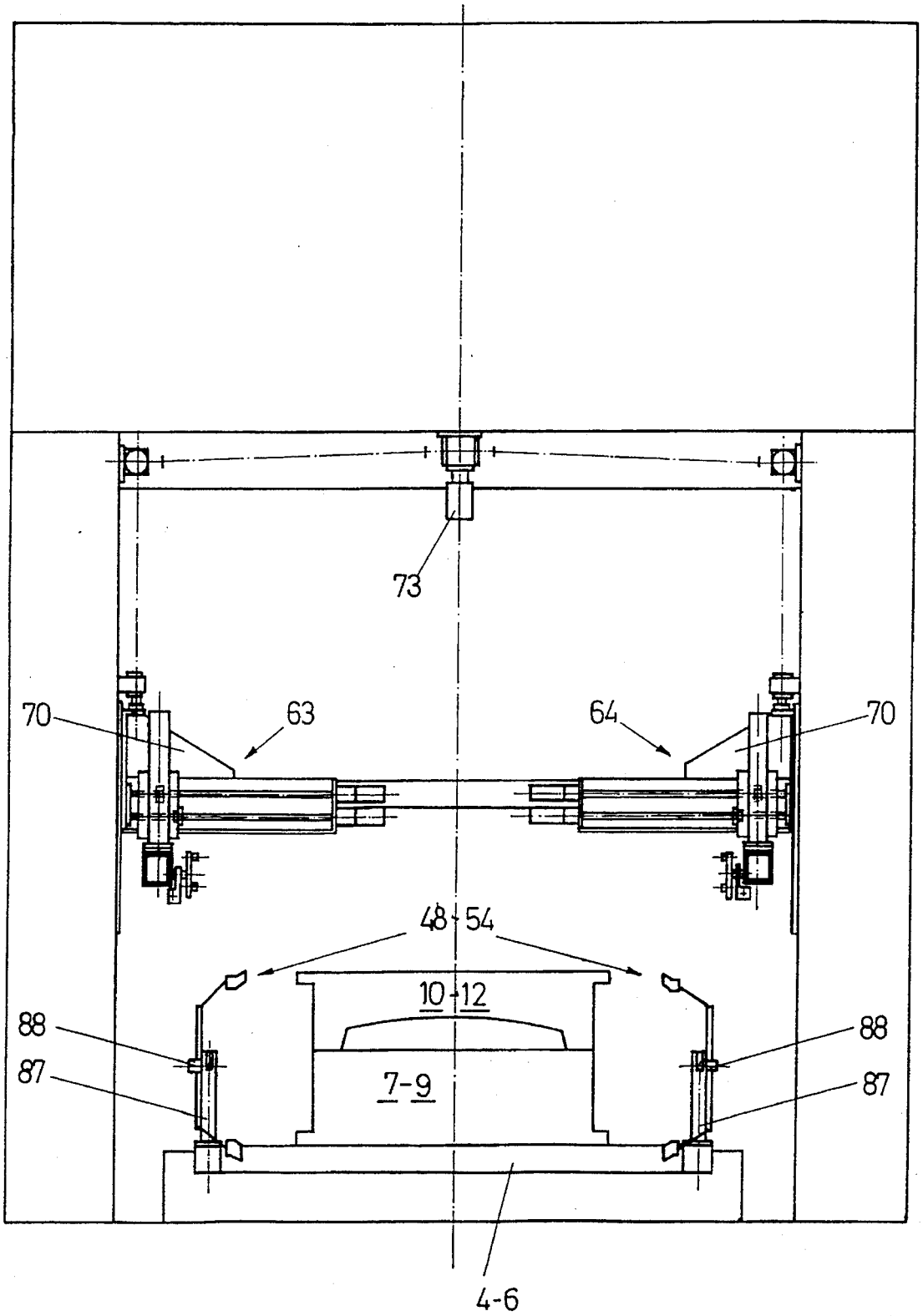

The embodiment according to FIGS. 8*a* to 8*c* corresponds, once again, to a 3-axis operation of the large-part multiple-die press as described with respect to FIGS. 7*a* to 7*c*, but in place of the transport unit 61, 62 having a belt drive, a transport unit 63, 64 having a spindle nut drive or a spline shaft-rack and pinion drive is shown, as has already been described in greater detail in respect of the illustrative embodiment according to FIGS. 6*a* to 6*c* for a 2-axis operation. Accordingly, reference is herewith made to the description of the transport units 63, 64 in FIGS. 6*a* to 6*c*. Identical parts are provided with the same reference symbols.

Consequently, in the illustrative embodiment according to FIG. 8*a*, the two transport units 63, 64 are able to perform with their spindle drives the transverse motion 55, so as to enable the gripper elements 48 to 54 to handle the workpiece 26 on both sides. Equally, the lifting columns 59, 60, which are driven by a spline shaft-rack and pinion drive, execute the necessary lifting motion according to the arrow 56.

FIG. 8*b* shows the 3-axis drive according to FIG. 8*a* in the pegging setting of the gripper elements 48 to 54 on the sliding tables 4 to 6. For this purpose, the gripper elements 48 to 54 are released from the receiving flange 68, 69 and lifted off by means of a swivel arm 88 on a swivel apparatus 87. The representation according to FIG. 8*c* likewise shows the conversion position of the 3-axis drive with gripper elements 48 to 54 pegged on the swivel arms, the swivel apparatus 87 having swiveled the swivel arm 88. This is done by a 90°-tilting of the swivel arms 88, so that the gripper elements lying in a horizontal plane in FIG. 8*b* lie in a vertical plane in FIG. 8*c*. Otherwise, identical parts are provided with the same reference symbols. The two transport units 63, 64, which are configured as spindle drives, are located in FIG. 8*c* once again in the upper conversion position on the brackets 70, which brackets are vertically adjustable on the spindles 71, 72. Identical parts are once again denoted by the same reference symbols as described above.

The embodiments of the invention which are described below according to FIGS. 9 to 14 show various embodiments of a large-part multiple-die press offering convertible 2-axis operation with cross-ties or 3-axis operation with gripper elements, separate orientation stages or empty stages, according to the embodiment according to FIGS. 2 and 4, being able to be relinquished. This is made possible by the fact that special receiving apparatuses for the alternative (selective) fastening of the cross-ties or gripper elements are provided, which are capable of performing longitudinal and swivel motions of their own, as described below.

Figure 9A:
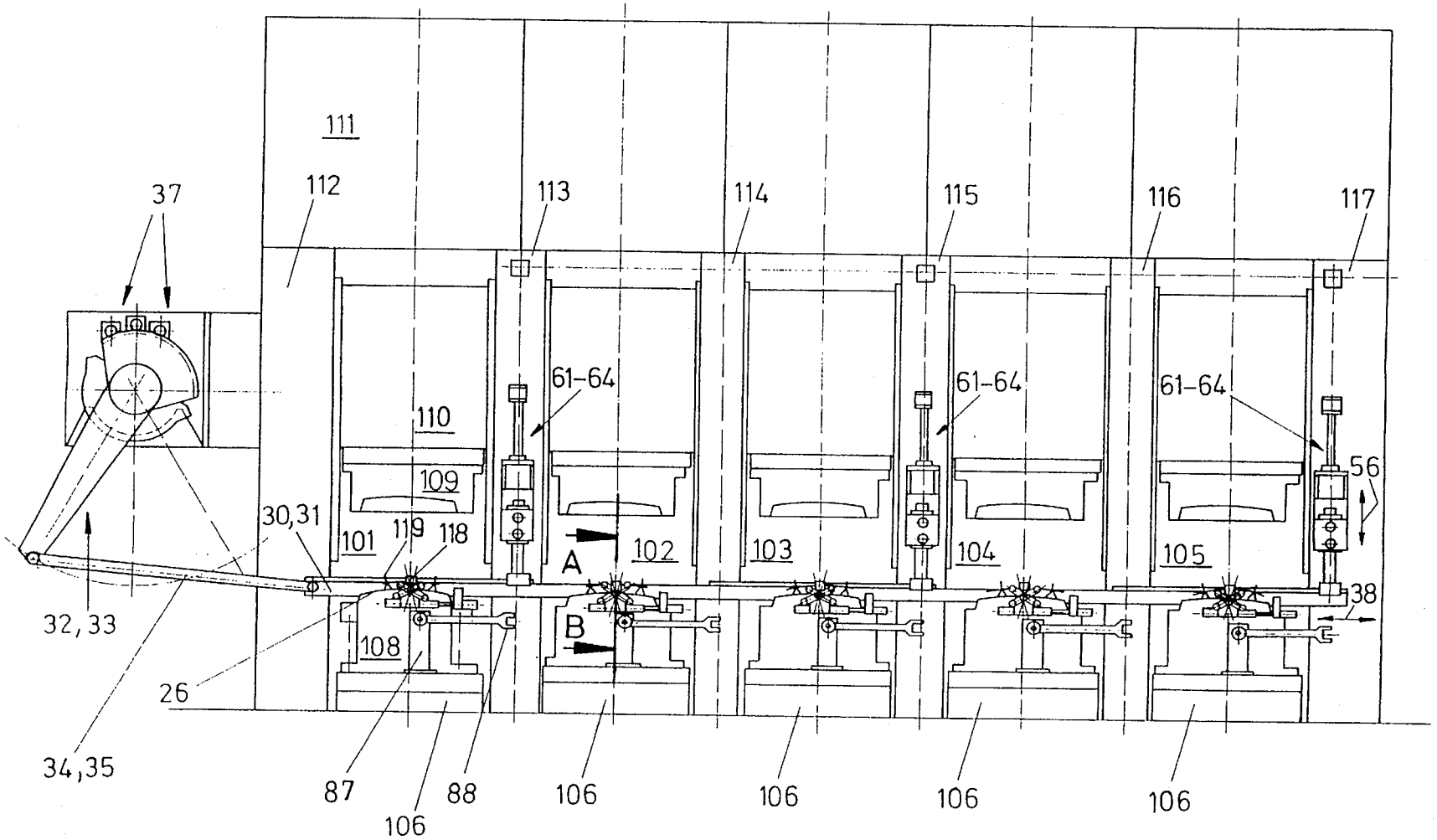
FIG. 9a shows an alternative embodiment of the LP-press to the illustrative embodiment according to FIGS. 1–4 in longitudinal section, without empty stages or orientation stages, in 2-axis operation with cross-ties in the withdrawal setting.

The large-part multiple-die press represented in longitudinal section in FIG. 9*a* comprises five machining stations 101 to 105 disposed directly next to one another, having respectively a sliding table 106 with a bottom die 108, a top die 109, and a press ram 110 and top beams or headpieces 111. The top die and bottom die serve the machining of a workpiece 26. The above parts are indicated in FIG. 9*a* essentially only in the first machining stage 101. Of course, all further machining stages contain the same or similar parts. The machining stages 101 to 105 are limited laterally by press uprights 112 to 117, in the illustrative embodiment according to FIG. 9*a* there being located in each second upright region, i.e. between the uprights 113, 115, 117, a transverse transport unit 61 to 64.

Extending through the whole of the press chamber are the parallel-running gripper rails 30, 31, which are driven in their longitudinal direction (arrow 38), through the use of push rods 34, 35 and by means of levers 32, 33, by drive motors 37, the drive motors 37 acting jointly upon a toothed segment. Alternatively, the drive can also be effected by the press drive, through the use of cam disks.

The vertical lifting motion (arrow 56), as well as a transverse motion (see arrow 55 in FIGS. 3 and 4) running transversely to the longitudinal direction 38 of the press, is performed by the transport units 61 to 64 in the manner previously described.

The illustrative embodiment according to FIG. 9*a* relates to a large-part multiple-die press with 2-axis drive, i.e. between the supporting rails 30, 31 there are located, in each machining station 101 to 105, cross-ties 118 with thereto fastened suction spiders 119. For conversion purposes in connection with a die-change, a swivel apparatus 87 having a swivel arm 88, as already described with respect to FIGS. 8*a* to 8*c*, is provided, which, according to the representation of the press in the conversion position according to FIG. 9*b*, lifts the cross-tie 118 with suction spider 119 off the receiving flange 68, 69 on the supporting rail 30, 31 and guides it into a 90°-swiveled position. This swivel-away position 89 is illustrated in dashed representation in FIG. 9*b*.

Figure 9B:
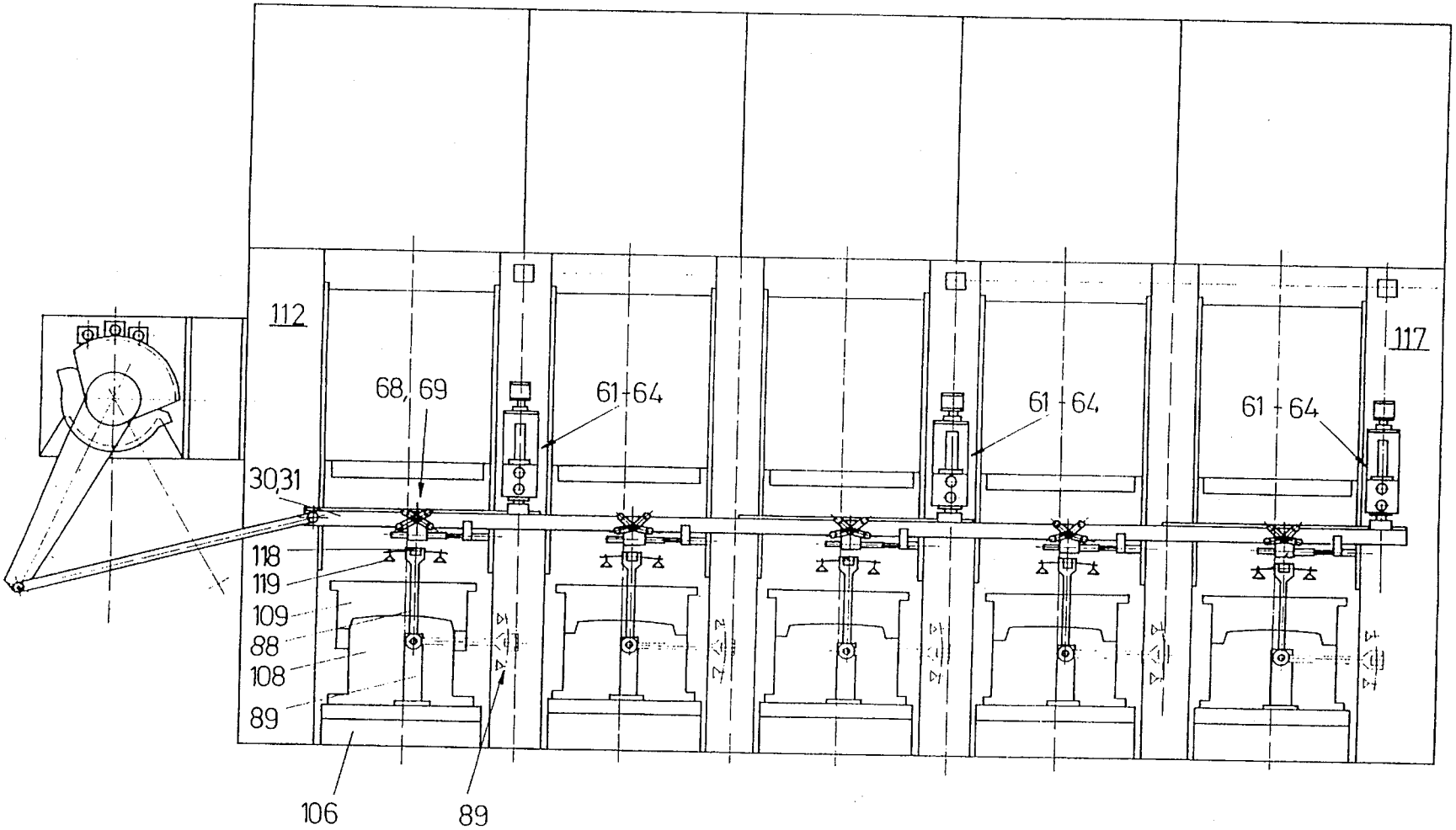
FIG. 9b shows a representation according to FIG. 9a, but in the die-change setting.
Figure 10A:
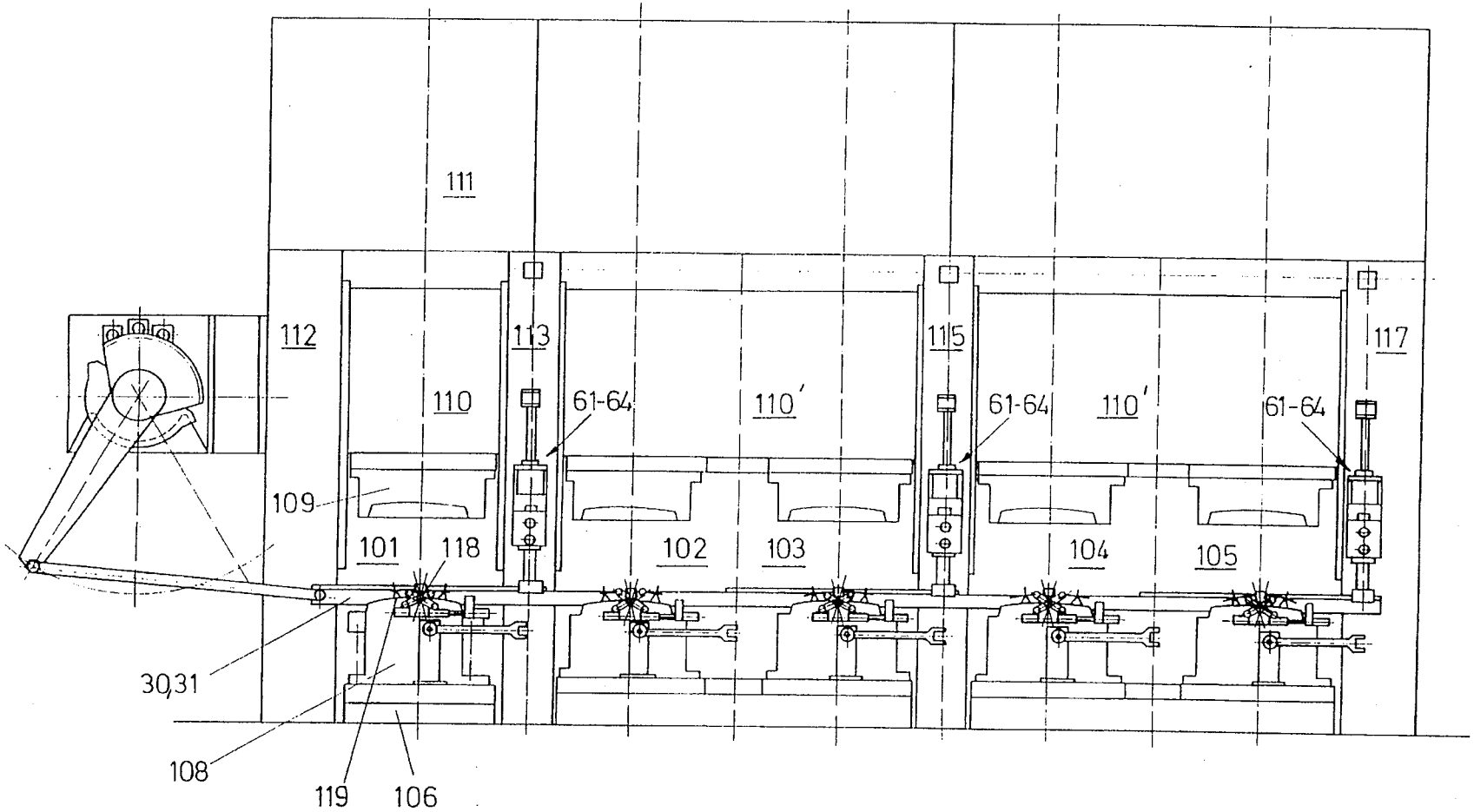
FIG. 10a shows an alternative embodiment to FIGS. 1 and 2, but without empty stage, in a longitudinal section through a LP-press in 2-axis operation, with cross-tie in the withdrawal setting of the workpiece.
Figure 10B:
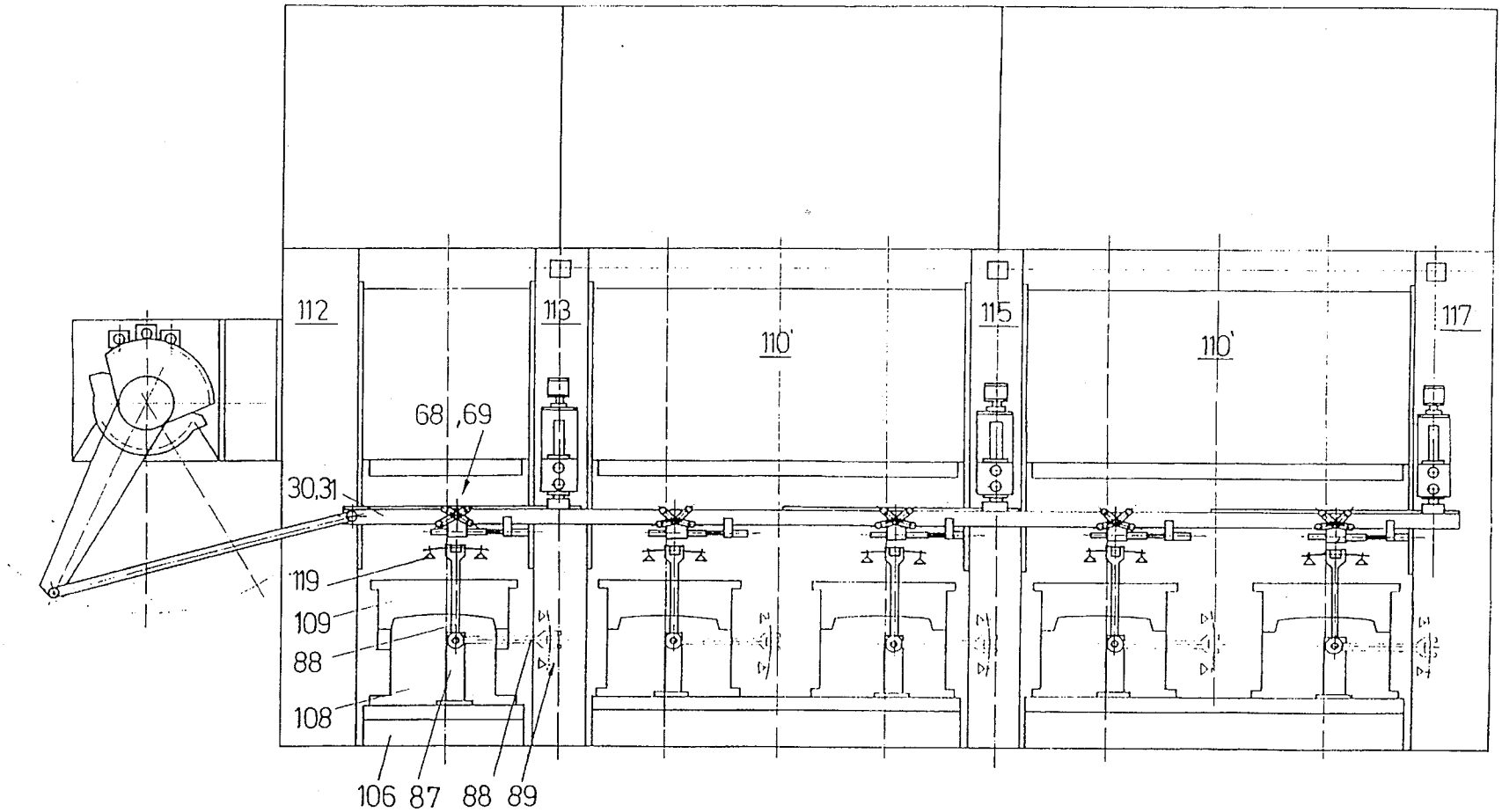
FIG. 10b shows a representation according to FIG. 10a, but in the die-change setting.

The illustrative embodiment of the invention according to FIGS. 10*a*, 10*b* shows the same state of affairs as the illustrative embodiment according to FIGS. 9*a*, 9*b*, but with a single press ram 110 in the first machining station 101 and subsequent double rams 110' for the subsequent machining stations 102, 103 and 104 and 105. Otherwise, the representation according to FIG. 10*a* relates to a longitudinal section through the large-part multiple-die press with 2-axial suction beam operation in the withdrawal setting, while FIG. 10*b* relates to the associated die-change setting analogous to the description according to FIG. 9*b*. Identical parts are once again provided with the same reference symbols as previously described. Consequently, in the illustrative embodiment according to FIGS. 10*a*, 10*b*, due to the double ram configuration, the two press uprights 114, 116 are absent. The machining stations 101 to 105 are equally present however.

Figure 11A:
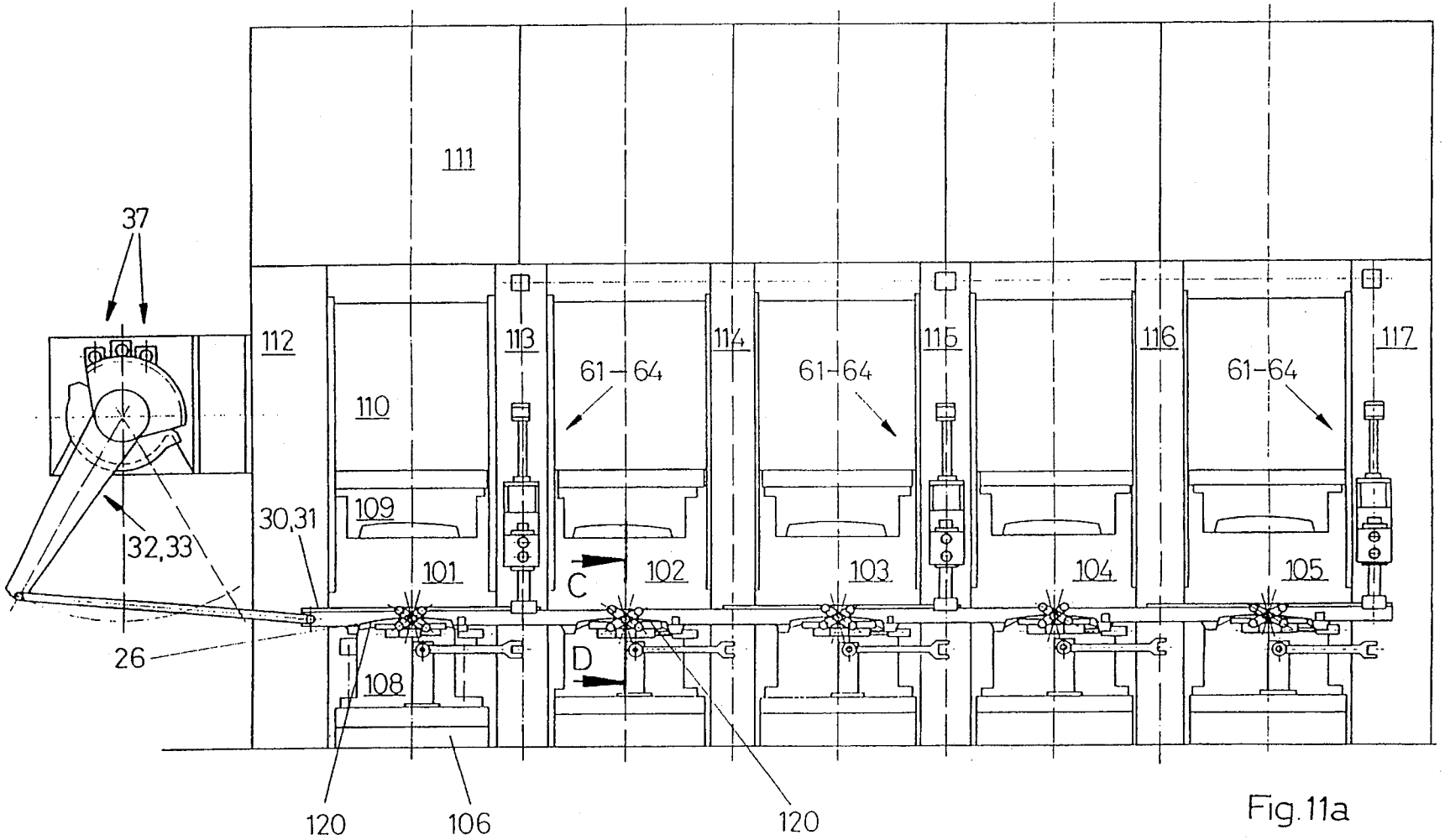
FIG. 11a shows an embodiment alternative to the illustrative embodiment according to FIG. 1, without empty stages and orientation stages, exhibiting single rams in 3-axis operation with grippers in the withdrawal setting.
Figure 11B:
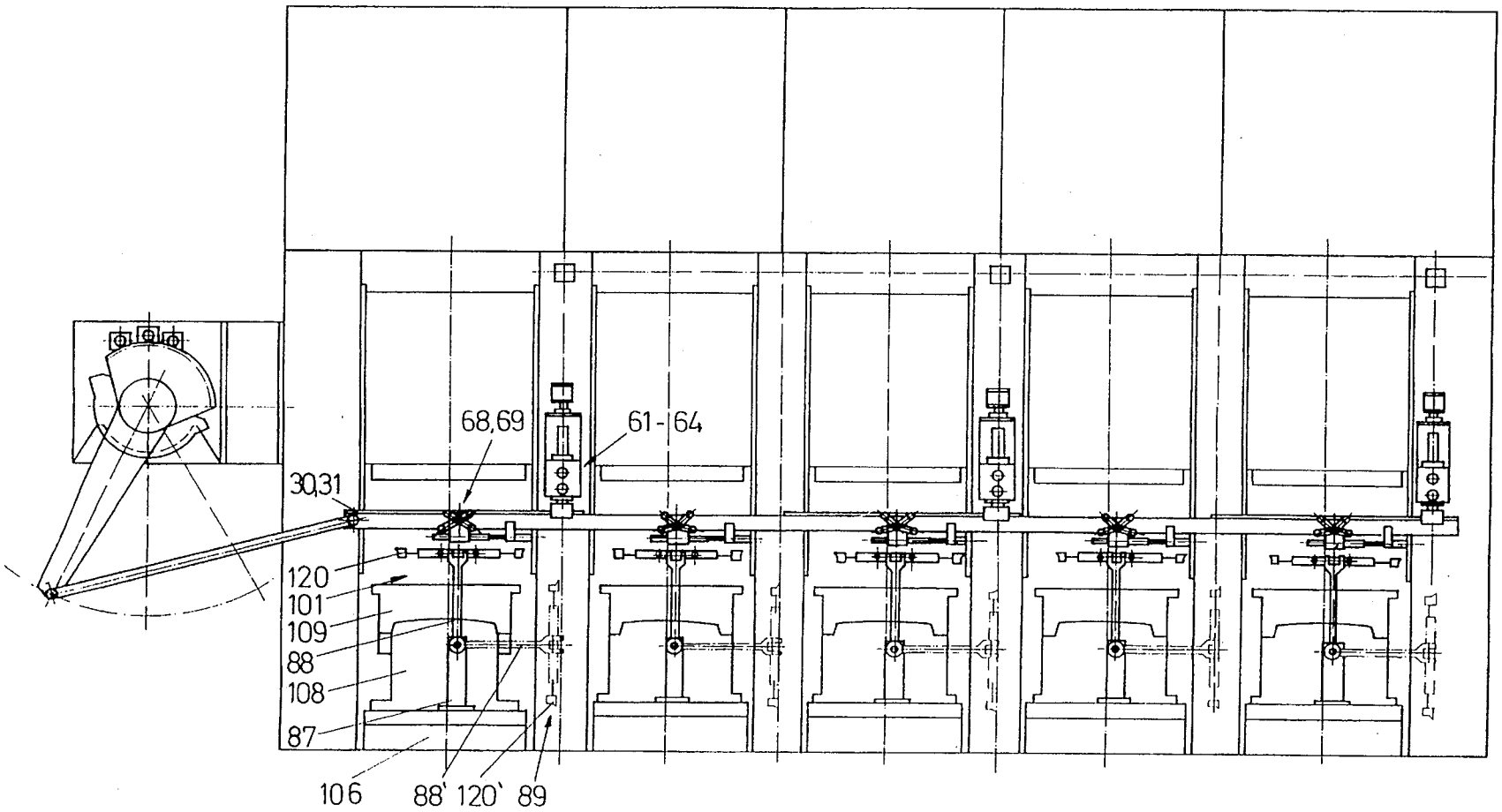
FIG. 11b shows the representation according to FIG. 11a, but in the die-change setting.

The illustrative embodiment of the invention in FIGS. 11*a*, 11*b* corresponds, once again, to a press construction as described with respect to FIGS. 9*a*, 9*b*. Identical parts are once again provided with the same reference symbols. In place of the 2-axis operation with suction beam transfer according to FIGS. 9*a*, 9*b*, in the illustrative embodiment according to FIGS. 11, 11*b*, however, a 3-axial press drive with gripper elements 120 is realized in each machining station 101 to 105. FIG. 11*a* herein shows, once again, a longitudinal section through the large-part multiple-die press, having, for example, five machining stations 101 to 105 disposed one behind the other, in 3-axis operation in the withdrawal setting of the workpiece 26, while FIG. 11*b* shows the associated conversion setting for the die-change. In this case, the gripper element 120 is pegged on the swivel arm 88 and subsequently decoupled from the receiving flange 68, 69 on the gripper rail 30, 31. The swivel apparatus 87 realizes a swivel motion about 90°, so that the gripper element 120, which in the machining station 101 in FIG. 11*b* is initially horizontally aligned, comes to rest in a vertical conversion position 120' in the swivel-away position 89 to the side of the sliding table 107. The swiveling-away of the swivel arm 88 occurs after the sliding table has traveled out of the press and facilitates the die-change. Equally, the transport units 61 to 64 have pulled the gripper rails 30, 31 upwards, as previously described. The bottom and top dies 108, 109, which are deposited one on top of the other, can then be transported laterally out of the press on the sliding table 107. The representation according to FIGS. 11*a*, 11*b* is basically reproduced in front view in FIGS. 8*a* to 9*c*.

Figure 12A:
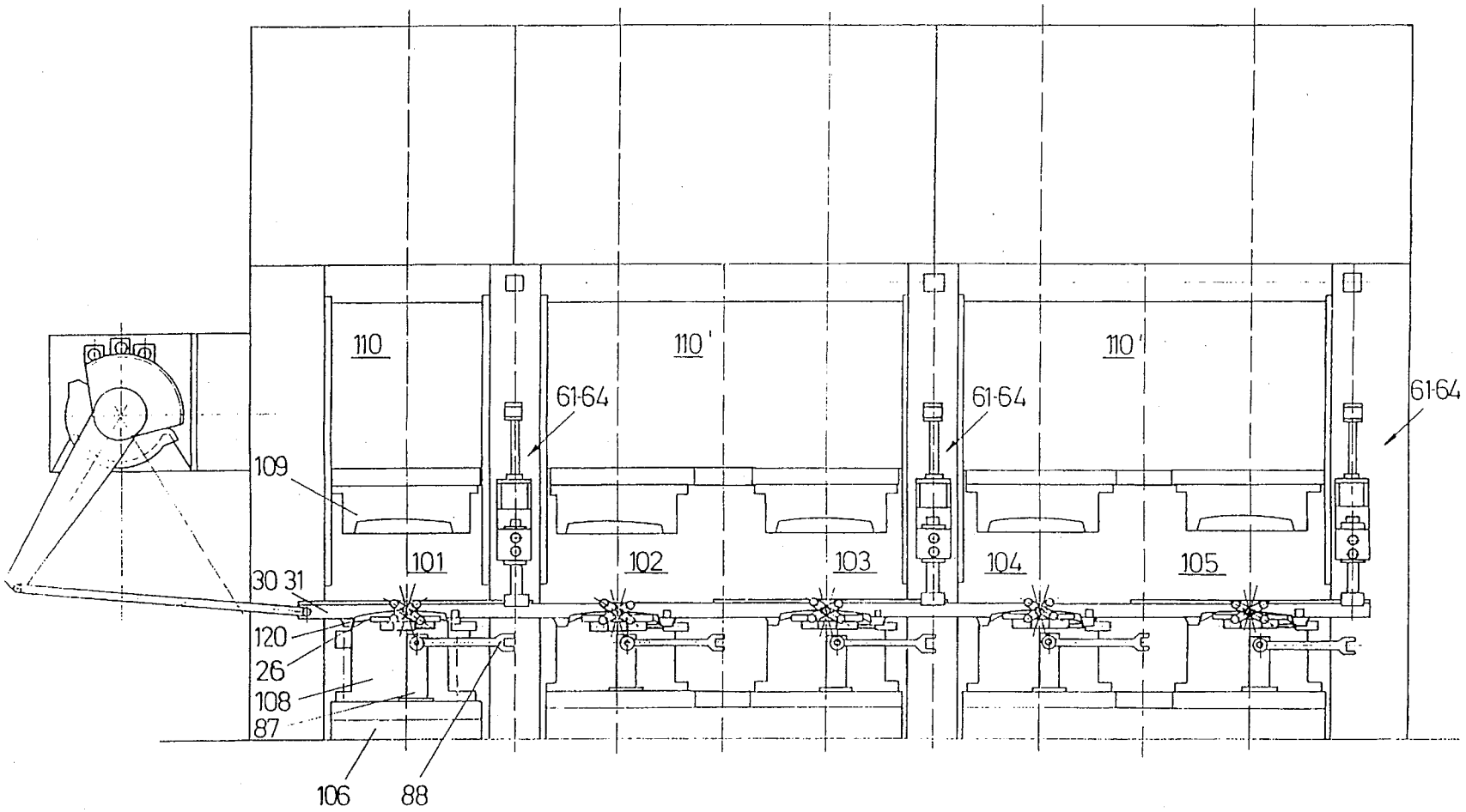
FIGS. 12a, 12b show a longitudinal section through a LP-press according to FIGS. 10a, 10b, but with 3-axis operation.
Figure 12B:
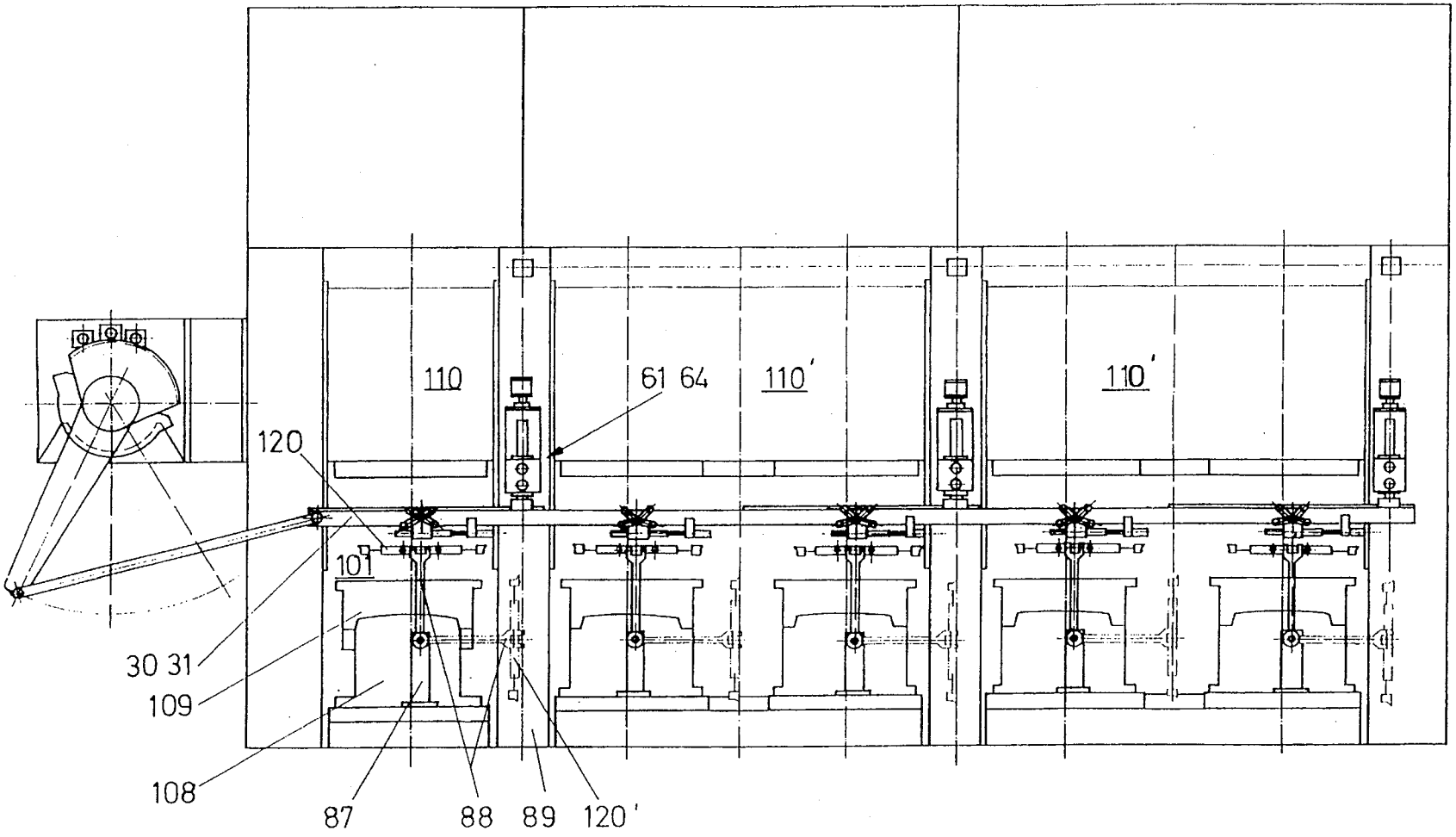

The further illustrative embodiment of the invention according to FIGS. 12*a*, 12*b* shows once again, analogously to FIGS. 10*a*, 10*b*, a press construction having a double ram 110' as described with respect to FIGS. 10*a*, 10*b*. In place of the 2-axial suction beam operation according to FIGS. 10*a*, 10*b*, in the illustrative embodiment 12*a*, 12*b*, however, a 3-axial gripper rail operation takes place, in which the gripper rails 30, 31 perform that transverse motion into the press chamber which is necessary to grasp the die. FIG. 12*a* shows, once again, a longitudinal section through the large-part multiple-die press with single ram 110 and double ram 110' and 3-axial gripper rail drive with gripper elements 120 in the withdrawal setting of the workpiece. FIG. 12*b* shows an associated representation according to FIG. 12*a* in the die-change setting, as described analogously with respect to FIG. 10*b*. Identical parts are once again provided with the same reference symbols.

In the illustrative embodiments of the invention according to FIGS. 9*a*, 9*b* to 12*a*, 12*b*, transport units 61 to 64 are fundamentally used, as are extensively described with respect to FIGS. 1 to 8.

In contrast to the illustrative embodiments according to FIGS. 1 to 8, the press arrangements according to FIGS. 9 to 12 exhibit no dedicated orientation station as an empty stage or intermediate stage, as is represented with reference symbols 21 to 25 in FIGS. 1 to 4. These orientation stations are required to change the positions of the workpieces between the individual machining stages. A drawback in this is the increased spatial requirement for such orientation stages, so that the press may exhibit a greater structural length in total.

According to the illustrative embodiments of FIGS. 9 to 12, those positional changes to the parts which are to be conducted by the orientation stations are integrated directly into the parts transportation, which in turn yields the substantial benefit of shorter structural length for the press.

Figure 13B:
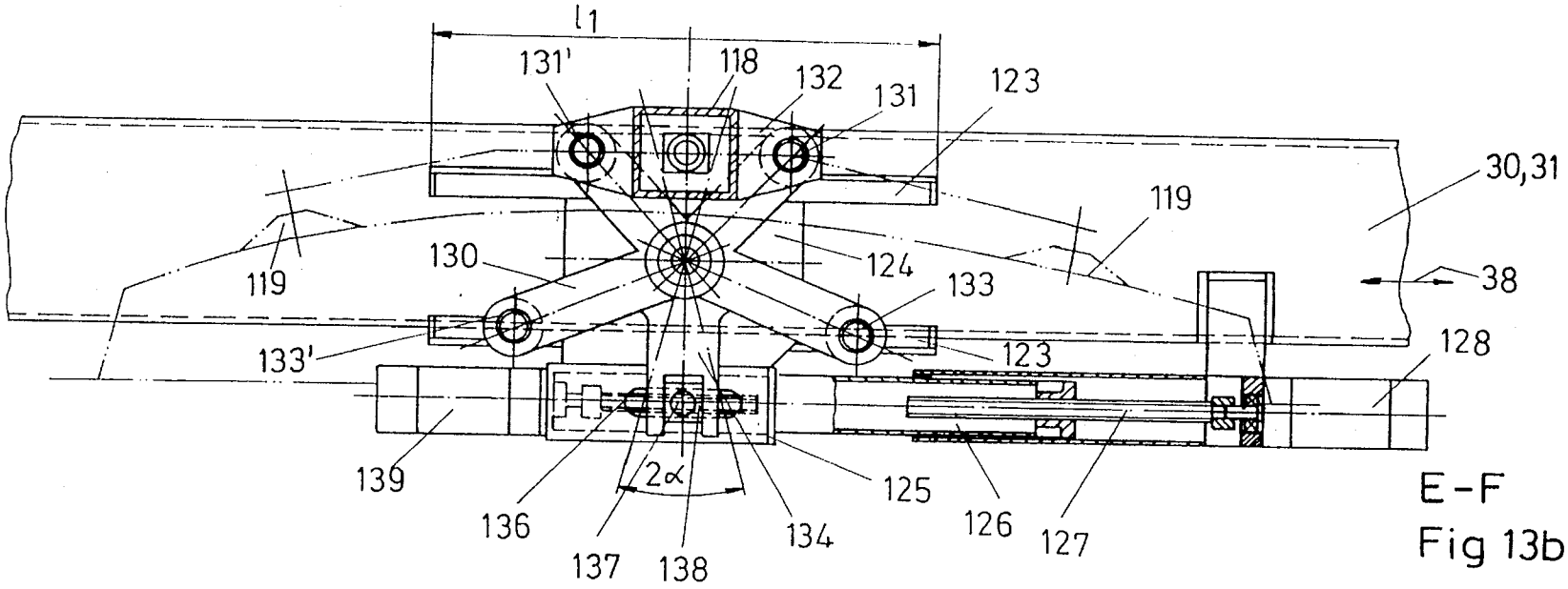

The refinement of the present invention therefore envisages, according to the illustrative embodiments according to FIGS. 9 to 12, that the positional change of the parts is effected between the individual machining stages 101 to 105 by a special additional drive in the region of the pegging holder 65, 66, as previously described. To this end, FIG. 13*a* shows a section along the sectional line A–B according to FIG. 9*a*, exhibiting an additional adjustment device 121 for a 2-axis operation with cross-tie 118 and suction spider 119. FIG. 13*b* shows an associated longitudinal section along the sectional line E–F in FIG. 13*a*.

Figure 14B:
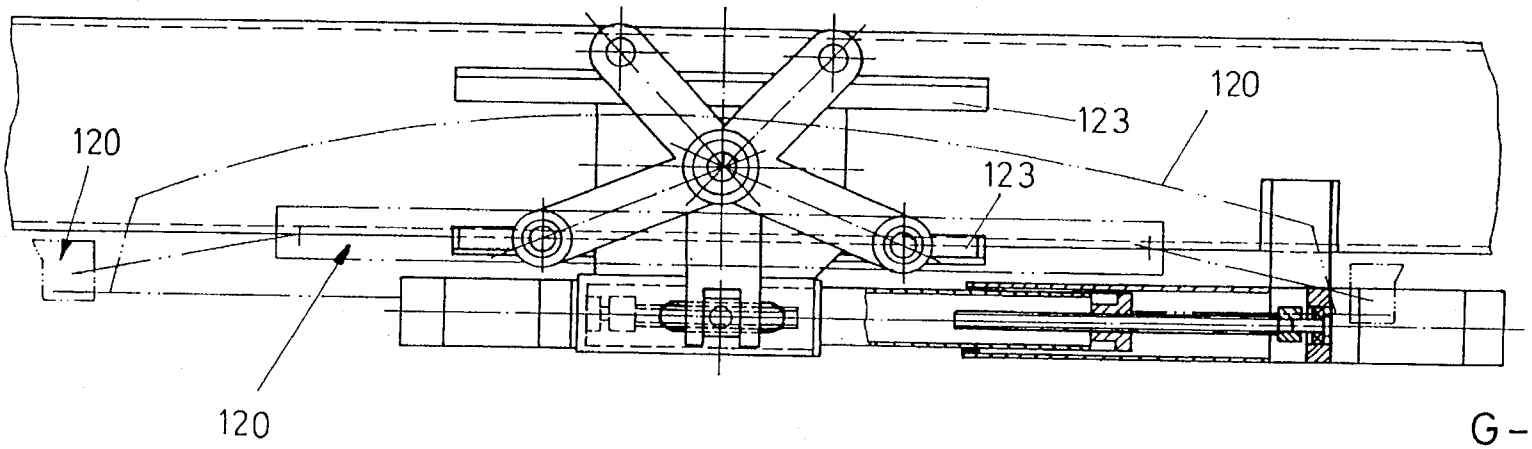

In contrast to the above, FIG. 14*a* shows a longitudinal section along the sectional line C–D in FIG. 11*a*, exhibiting a 3-axial gripper rail drive with gripper elements 120, with a sectional representation along the sectional line G–H in FIG. 14*b*. The same also applies, of course, to the double ram configuration according to FIGS. 10 and 12.

The adjustment device 121 is configured as a swivel and displacement device and serves to change the position of the workpieces during transportation or depositing from one die stage to the next die stage. The adjustment device is herein disposed on the inner side 122, facing the die chamber, of the supporting or gripper rails 30, 31. For this purpose, the supporting or gripper rail 30, 31 of square or rectangular cross section exhibits, on the inner guide face 122, a longitudinal slide guide 123, in which there is guided a slide 124 which is displaceable parallel to the supporting or gripper rail. In accordance with the representation according to FIG. 13*b*, the longitudinally displaceable slide 124 exhibits a connecting flange 125 for a horizontally disposed adjusting guide 126, which connecting flange, by means of a spindle 127, is longitudinally displaceable by means of a programmable spindle drive 128. The slide 124 is consequently able to be longitudinally displaced in the slide guide 123, in the longitudinal direction 38 of the press, by a specific amount corresponding to the length $l_1$ of the longitudinal slide guide relative to the supporting and gripper rail arrangement. This longitudinal displaceability is transmitted to the cross-tie 118 or the gripper elements 120 and serves also to equalize the individual steps. A step-equalization of this kind, i.e. a relative longitudinal displacement in relation to the feed step of the supporting or gripper rails, can be necessary as a result of the positional change of the workpiece which is brought about by the swivel motion.

By means of a central bearing bolt 129 through the longitudinally transportable slide 124, a type of swivel cross 130 is provided, at the two upper ends of which there are provided two connecting bolts 131, 131' for the fastening of a cross-tie 118 with suction spider 119, a cross-yoke 132 serving as a connecting plate. In 2-axis suction beam operation, the two upper connecting bolts 131, 131' are consequently fitted with the cross-tie.

The swivel cross 130 further contains, on its two lower wings, two further connecting bolts 133, 133', which, in accordance with the representation according to FIGS. 14*a*, 14*b*, serve to receive the gripper elements 120 on gripper bars. Optionally, the swivel cross 130 can consequently receive, in its upper region for 2-axis operation, the cross-ties 118 and, in its lower region for 3-axis operation, the gripper elements 120.

The swivel cross 130, and hence also the connections for the cross-tie 118 or gripper elements 120, is mounted, moreover, pivotably about the rotational axis of the bearing bolt 129. To this end, a further, downwardly directed arm 134 of the swivel cross 130 leads to a swivel drive 135. The swivel drive 135 comprises a horizontally disposed spindle 136, which interacts with a spindle nut 137 with swivel bolt and sliding block 138, in order to deflect the swivel arm 134. A programmable swivel drive 139 is connected by means of a housing 140 to the longitudinally transportable slide 124.

The programmable swivel drive 139 consequently therefore acts via the sliding block 138 upon the arm 134 of the swivel cross 130 for the purpose of a swivel motion about an angle 2 α, as is illustrated in FIG. 13*b* as a deflection from the vertical axis.

The described adjustment device 121 with swivel device and longitudinal adjustment device, in the illustrative embodiment according to FIGS. 1 to 12, is able to replace the receiving flanges described in the preceding figures for the respectively optional fastening of the cross-ties or gripper elements. The swivel and adjustment devices 121 can also however be used, in all the illustrative embodiments according to FIGS. 1 to 12, to change the position of the workpiece. Insofar as, in these especially frontal views, the receiving flanges 68, 69 are respectively denoted, these should be understood also to include swivel and displacement devices according to the illustrative embodiments according to FIGS. 13 and 14.

FIGS. 13*a*, 14*a* show, in particular, also the lifting columns 59, 60 and the fastening of these lifting columns by means of a respective longitudinal guide slide 57, 58, as described in the preceding figures. These longitudinal guide slides 57, 58 respectively comprise two associated longitudinal guide bars 141, 142, [lacuna] bear [lacuna], with corresponding antifriction mounting 143, for a longitudinal displacement. The central drive 32, 33 is consequently able to displace the supporting or gripper rails 30, 31 longitudinally, without any influence coming to bear upon the position of the lifting columns 59, 60.

In the above designs, the supporting and gripper rails 30, 31 are denoted as supporting rails in connection with a 2-axis drive with a suction beam transfer and as gripper rails in 3-axis operation with transversely displaceable gripper elements.

The invention is not restricted to the illustrative embodiment which has been represented and described, but rather also embraces all expert refinements within the framework of the inventive concept.

We claim:

1. A transport device of a press for transporting workpieces in a longitudinal direction of the press and through a plurality of machining stations, comprising:

two parallel gripper-and-supporting rails for receiving and transporting the workpieces through the machining stations;

fastening means connected to each respective rail for selectively fastening one of a gripper element and a cross-tie having a suction spider attached thereto, to the respective rail, said suction spider and said gripper element engaging the workpieces;

advancement means operatively connected to said rails for moving said rails in a horizontal, longitudinal direction of the press;

lifting means operatively connected to said rails for moving said rails in an aligned, vertical direction;

closing/opening means operatively connected to said rails for moving said rails in a direction transverse to the longitudinal direction of the press; and drive means operatively connected to said advancement means, said lifting means, and said closing/opening means for causing a motion sequence of the selected one of the cross-tie and gripper element to engage and move the workpiece through the machining stations.

2. The transport device defined in claim 1, wherein said drive means comprises at least one of a switchable cam drive and programmable individual drives.

3. The transport device defined in claim 1, wherein the press comprises one of a multiple-die press and a transfer press.

4. The transport device defined in claim 1, wherein said advancement means comprises a longitudinal drive, and said lifting means and said closing/opening means comprises a plurality of transverse transport units operatable independently of said longitudinal drive, each said transverse transport unit including a vertically displaceable lifting mechanism connected to a respective rail for lifting said rails in the vertical direction, said lifting mechanisms being mounted so as to be displaceable in the direction transverse to the longitudinal direction of the press.

5. The transport device defined in claim 4, further comprising slide guides for fastening the respective rails to the respective lifting mechanisms, said slide guides allowing for the displacement of said rails in, and counter to, the longitudinal direction of the press.

6. The transport device defined in claim 4, wherein each said transport unit includes a supporting slide that is transversely displaceable relative to the longitudinal direction of the press, and wherein each said lifting mechanism comprises a lifting column mounted in a respective supporting slide.

7. The transport device defined in claim 6, wherein each said transport unit includes a horizontally arranged guide device having said supporting slide mounted thereon for allowing the transverse displacement, relative to the longitudinal direction of the press, of said supporting slide.

8. The transport device defined in claim 7, further comprising a plurality of vertically adjustable brackets, each having a respective transport unit mounted thereon.

9. The transport device defined in claim 6, wherein each transport unit includes a horizontal drive attached to a respective supporting slide for transversely moving said supporting slide, said lifting column, and said rail, said horizontal drive comprising programmable servo motors, and one of a belt drive and a spindle drive attached to said servo motors.

10. The transport device defined in claim 6, wherein each transport unit includes a vertical drive attached to a respective lifting column for vertically adjusting said lifting column and said rail, said vertical drive comprising programmable servo motors, and one of a cable drive, belt drive, and a spline-shaft drive attached to said servo motors.

11. The transport device defined in claim 9, wherein said horizontal drive comprises the belt drive, said belt drive including a plurality of deflection rollers located at respective ends of said transport unit, and a drivable traction mechanism wrapped around said deflection rollers, said belt drive being activatable to cause said supporting slide to be transversely displaced relative to the longitudinal direction of the press.

12. The transport device defined in claim 10, wherein said vertical drive comprises one of the cable drive and the belt drive, and includes deflection rollers located on said supporting slide and said lifting column, and a drivable traction mechanism wrapped around said deflection rollers and being held at an end of said transport unit, said traction mechanism forming a respective upper and lower deflection loop around said deflection rollers and at said lifting column, said deflection loops being adjustable in length for the vertical adjustment of said lifting column and rail.

13. The transport device defined in claim 1, wherein the various movements of said rails define production axes along which the workpieces are transported.

14. The transport device defined in claim 6, wherein the vertical movement of said lifting column defines a first production axis along which the workpieces are transported, and the transverse movement of said supporting slide defines at least one of a set-up axis for changing of a die, and a second production axis along which the workpieces are transported.

15. The transport device defined in claim 1, wherein said lifting means and said closing/opening means are positioned in one of the following locations: between adjacent uprights of the press, and in workpiece orientation stations located between adjacent machining station of the press.

16. The transport device defined in claim 1, wherein each said fastening means comprises a plurality of receiving flanges, each receiving flange of a respective rail being associated with a selected machining station, and each including swivel-and-displacement means for the selective reception of one of the cross-tie and a gripper bar with the gripper elements attached thereto.

17. The transport device defined in claim 1, wherein each said fastening means comprises a swivel-and-displacement device for the selective reception of one of the cross-tie and a gripper bar with the gripper elements attached thereto; a drivable slide slidably attached to said rail, being displaceable in the longitudinal direction of the press, and having said swivel-and-displacement device attached thereto; and swivel means connected to said drivable slide and said swivel-and-displacement device for causing a swivel motion of the selected one cross-tie and gripper bar about a horizontal transverse axis.

18. The transport device defined in claim 17, further comprising a programmable spindle drive having a servo motor and being connected to said drivable slide to move the fastening means in the longitudinal direction of the press.

19. The transport device defined in claim 17, wherein said swivel-and-displacement device includes a lever-like swivel arm; and wherein said swivel means comprises a programmable spindle drive connected to a said swivel arm for causing the swivel motion.

20. The transport device defined in claim 17, wherein said swivel-and-displacement device forms a cross-shape having four legs, two legs of the cross-shape having bearing bolts therein for attachment of the cross-tie to said swivel-and-displacement device, and the other two legs of the cross-shape having connecting bolts therein for attachment of the gripper elements to said swivel-and-displacement device.

21. The transport device defined in claim 17, wherein each said rail has a longitudinally arranged slide guide, with said drivable slide being slidably located therein, said swivel-and-displacement device forming a swivel cross and having said drivable slide attached by way of a central bearing bolt thereto, said swivel cross having a plurality of connecting bolts for connection of the cross-tie and gripper elements thereto, and being mounted to pivot about the horizontal axis, and wherein said swivel means comprises a swivel drive connected to said swivel cross to effect its pivoting.

22. The transport device defined in claim 4, wherein each transport unit includes a supporting slide attached to a respective lifting mechanism, and a horizontal drive attached to said supporting slide for transversely moving said supporting slide, said lifting mechanism, and said rail, said horizontal drive comprising programmable servo motors, and one of a belt drive and a spindle drive attached to said servo motors.

23. The transport device defined in claim 4, wherein said transport units are positioned in one of the following locations: between adjacent uprights of the press, in empty machining stations, and in workpiece orientation stations located between adjacent machining station of the press.

* * * * *